US008113970B2

(12) United States Patent
Mauer et al.

(10) Patent No.: US 8,113,970 B2
(45) Date of Patent: Feb. 14, 2012

(54) BATTING AID DEVICE HAVING AUTOMATIC BALL FEED

(76) Inventors: Donald Mauer, St. Paul, MN (US); Gregory Knutson, St. Paul, MN (US); James Mauer, Minnetonka, MN (US)

( * ) Notice: Subject to any disclaimer, the term of this patent is extended or adjusted under 35 U.S.C. 154(b) by 0 days.

(21) Appl. No.: 12/263,932

(22) Filed: Nov. 3, 2008

(65) Prior Publication Data

US 2009/0227401 A1 Sep. 10, 2009

Related U.S. Application Data

(60) Provisional application No. 60/984,464, filed on Nov. 1, 2007.

(51) Int. Cl.
*A63B 69/00* (2006.01)

(52) U.S. Cl. ..... 473/451; 473/417; 124/50; 124/51.1

(58) Field of Classification Search ..... 473/417, 473/418, 422, 451; 124/9, 10, 50, 78, 51.1
See application file for complete search history.

(56) References Cited

U.S. PATENT DOCUMENTS 2,729,206 A * 1/1956 Wilson ..... 124/78
3,604,409 A 9/1971 Doeg
3,815,567 A 6/1974 Serra
4,132,214 A * 1/1979 Schnurr et al. ..... 124/1
4,299,383 A * 11/1981 Yuasa ..... 473/436
4,552,120 A * 11/1985 Nall et al. ..... 124/1
4,896,646 A * 1/1990 Kahelin et al. ..... 124/51.1
5,042,802 A * 8/1991 Depianta ..... 124/50
5,066,010 A 11/1991 Pingston
5,097,985 A * 3/1992 Jones ..... 221/86
5,123,643 A 6/1992 Heilhecker et al.
5,160,131 A * 11/1992 Leon ..... 473/451
5,232,218 A 8/1993 Leps
5,292,119 A 3/1994 Norcross
5,294,109 A * 3/1994 Meade ..... 124/54
D348,709 S 7/1994 Leps
D355,445 S 2/1995 Boyd
D355,936 S 2/1995 Boyd
5,396,876 A * 3/1995 Liscio et al. ..... 124/6
5,421,313 A 6/1995 Strayer
5,490,493 A * 2/1996 Salansky ..... 124/78
5,558,324 A * 9/1996 Jourdan ..... 124/83
5,826,568 A 10/1998 Van Ross, Jr.
5,836,837 A 11/1998 Craig
6,085,735 A 7/2000 Cheek, Jr.
6,176,036 B1 1/2001 Pease
6,190,271 B1 * 2/2001 Rappaport et al. ..... 473/451
6,276,353 B1 8/2001 Briggs et al.
(Continued)

*Primary Examiner* — Mark Graham
(74) *Attorney, Agent, or Firm* — Dicke, Billig & Czaja, PLLC

(57) ABSTRACT

An automatic feed mechanism for use with a batting aid device having a first end configured to receive a ball and a second end configured to drop the ball from the batting aid device. The automatic feed mechanism includes a substantially enclosed tubular member configured to receive a ball from the batting aid device and defining an internal support surface configured to support the ball, a wheel coupled to and positioned at least partially within the tubular member and having a rotational axis orientated substantially perpendicular to a longitudinal extension of the tubular member, and a motor configured to rotate the wheel at least a portion of a full rotation; wherein as the wheel rotates, the wheel is configured to engage and advance the ball through the tubular member in a direction from the first end toward the second end of the batting aid device.

21 Claims, 19 Drawing Sheets

U.S. PATENT DOCUMENTS

| | | | | |
|---|---|---|---|---|
| 6,296,581 | B1 * | 10/2001 | Sever | 473/422 |
| 6,644,294 | B2 | 11/2003 | Christensen | |
| 6,772,745 | B2 | 8/2004 | McEachen et al. | |
| 6,974,396 | B2 * | 12/2005 | Mauer et al. | 473/417 |
| 7,231,913 | B2 * | 6/2007 | Wilson | 124/78 |
| 2002/0082125 | A1 * | 6/2002 | Markin | 473/451 |
| 2002/0155907 | A1 * | 10/2002 | Bewley | 473/451 |
| 2003/0006319 | A1 | 1/2003 | Silverstein et al. | |
| 2003/0125139 | A1 * | 7/2003 | Gottlieb-Myers et al. | 473/451 |
| 2004/0087390 | A1 * | 5/2004 | Mauer et al. | 473/417 |
| 2005/0009646 | A1 * | 1/2005 | Johnston | 473/451 |
| 2006/0003857 | A1 * | 1/2006 | Mauer et al. | 473/451 |
| 2006/0135290 | A1 * | 6/2006 | Lin | 473/451 |
| 2006/0236993 | A1 * | 10/2006 | Cucjen et al. | 124/78 |
| 2007/0142131 | A1 * | 6/2007 | McBride et al. | 473/451 |
| 2008/0184979 | A1 * | 8/2008 | Estalella | 124/16 |
| 2009/0095273 | A1 * | 4/2009 | Paulson et al. | 124/78 |

* cited by examiner

BATTING AID DEVICE HAVING AUTOMATIC BALL FEED

BACKGROUND

In sporting activities such as baseball and softball, which involve hitting a ball with a bat, the development of hand-eye coordination and swing speed are important to successfully and consistently hit the ball. Activities such as "soft toss"and devices such as batting tees are designed to improve hand-eye coordination and swing speed.

For these and other reasons, there is a need for the present invention.

SUMMARY

One embodiment provides an automatic feed mechanism for use with a batting aid device having a first end configured to receive a ball and a second end configured to drop the ball from the batting aid device. The automatic feed mechanism includes a substantially enclosed tubular member configured to receive a ball from the batting aid device and defining an internal support surface configured to support the ball, a wheel coupled to and positioned at least partially within the tubular member and having a rotational axis orientated substantially perpendicular to a longitudinal extension of the tubular member, and a motor configured to rotate the wheel at least a portion of a full rotation; wherein as the wheel rotates, the wheel is configured to engage and advance the ball through the tubular member in a direction from the first end toward the second end of the batting aid device.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION

Figure 1A:
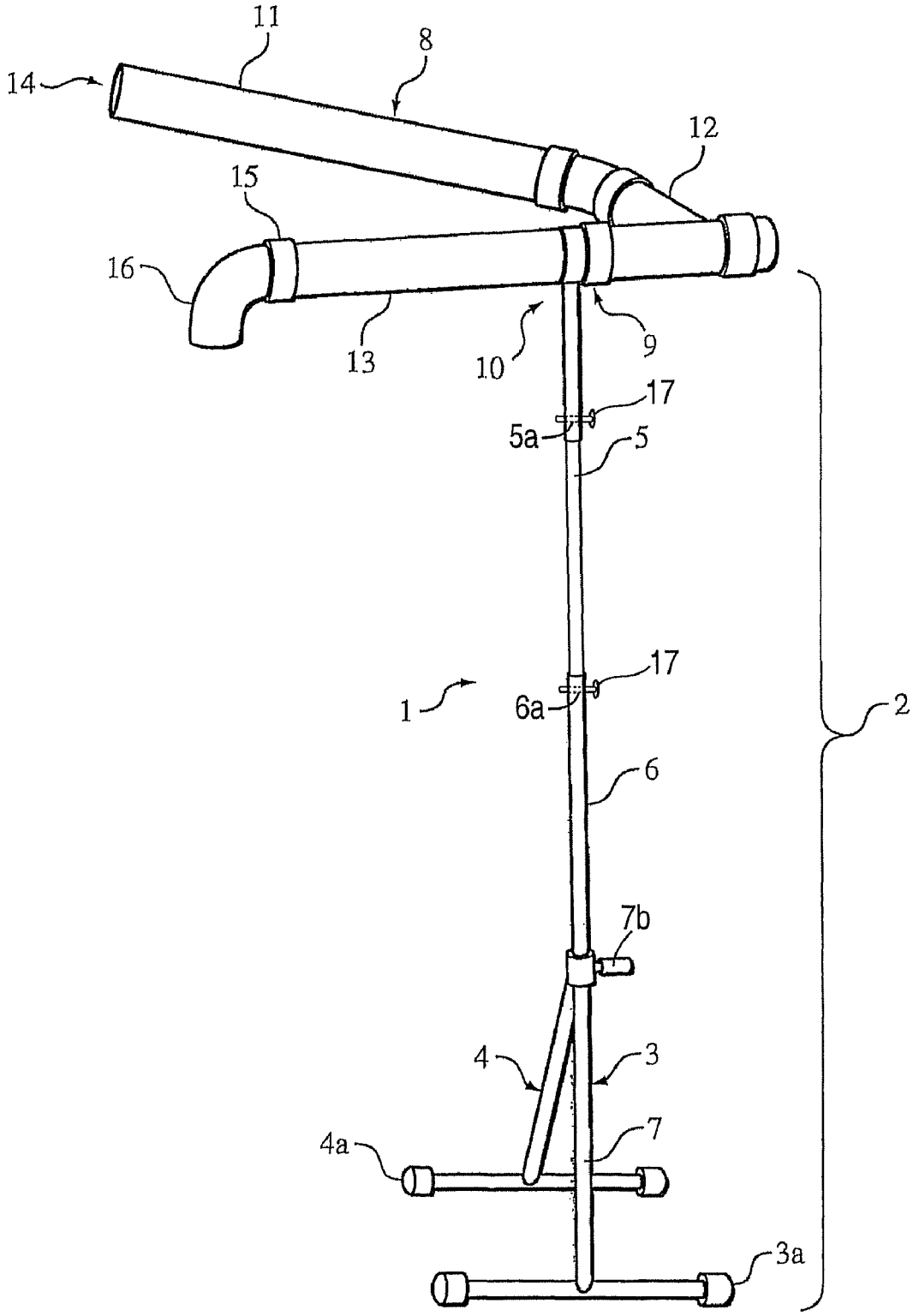
FIG. 1A illustrates a perspective view of one embodiment of a batting aid device.

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading,""trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

It is to be understood that the features of the various exemplary embodiments described herein may be combined with each other, unless specifically noted otherwise.

Embodiments relate to an improved batting aid device. The device can be used by right-handed or left-handed hitters, and be operated individually or with a partner. The device is designed to improve hand-eye coordination, reflexes, muscle memory, and timing in hitting a ball with a bat, and to develop a quicker, more compact swing. In some embodiments, the device is adjustable to allow increasing or decreasing levels of difficulty, is adjustable to different heights, and is foldable for easy storage and transport.

In general, the device includes a stand having a bottom portion and a top portion and a plastic tube attached to the top portion. A ball, for example a baseball, wiffle baseball, or wiffle golf ball can be placed in the tube at a first end of the tube or at a position along the tube. The tube is positioned such that the ball will travel by gravity to a second end of the tube and exit the tube at a selected exit angle, e.g. straight downward, 45 degrees, etc. In one embodiment, the tube is opaque so as to prevent the user from visualizing the ball as it travels in the tube. As the ball exits the end of the tube, the user can visualize the ball and attempt to hit it with a bat, stick, or the like.

In one embodiment, the stand of the device includes two legs at the bottom portion wherein one leg is collapsible, and further includes multiple telescoping sections. The multiple telescoping sections allow the device to be adjusted to different heights to accommodate the stature of the user. In one embodiment, the stand includes two legs with one leg collapsible, and three telescoping sections that allow the device to be adjusted between twenty-four inches tall and sixty-six inches tall. A stand with the foregoing features has the additional advantage of being folded and compacted to fit within a small space such as the trunk of an automobile. The elements of the device can be fabricated from any desired material. The stand, for example, may be fabricated from metal to add weight and stability to the device, or may be fabricated from plastic to provide a more lightweight device, e.g. for small children to use. In one embodiment, the hollow tube and rotatable mechanism are fabricated from plastic or other lightweight material to prevent the device from being top heavy. The tube can be a single piece or have multiple sections as desired for versatility or compact storage. In one embodiment, the tube and rotatable mechanism are fabricated from injection-molded plastic.

The tube may be attached to the top portion of the stand using any suitable means, for example a metal ring or clamp adapted to tightly fit around the tube and be attached to the top portion of the stand in conjunction with an adjustable dial or knob used to connect the ring holding the tube to the stand. The plastic tube may be "L" shaped or a generally sideways "V" or "V" shaped and include multiple sections that allow for disassembly or multiple adjustments. In a sideways "V" configuration, a user can load the device with a ball at the first end of the plastic tube (the upper end of the sideways "V", and remain in position to hit the ball as it exits the second end of the tube (the lower end of the sideways "V". The plastic tube may also be a single, molded tube.

The means of attachment of the tube to the stand may further include a knob to adjust the plastic tube such that a ball placed in the tube travels downward toward the second end of the tube by the force of gravity. The plastic tube may further include, at its second end, a mechanism that allows adjustment of the exit path for the ball. The mechanism may include, for example, a curved section of plastic tubing that may be fitted, via a fitting designed to slide onto the second end of the tube, allowing adjustment of the angle of exit of the ball. Such adjustability is particularly advantageous for altering the degree of difficulty in hitting the ball exiting the tube with a straight vertical downward path providing a higher degree of difficulty than, for example, a horizontal or angled path.

FIG. 1A illustrates a perspective view of one embodiment of the batting aid device as described above. The device 1 includes a stand 2, wherein the stand includes two legs 3 and 4. Leg 4 is collapsible toward leg 3. Legs 3 and 4 may further include feet 3*a* and 4*a*. Feet 3*a* and 4*a* extend perpendicularly from the legs 3 and 4 at the base of legs 3 and 4. In one embodiment, feet 3*a* and 4*a* include telescoping sections that allow the feet to be extended and provide further stability to the device during use, and allow the device to be more compact when stored or transported. The stand further includes telescoping sections 5, 6, and 7. In the embodiment as illustrated in FIG. 1A, hollow plastic tube 8 is attached, at attachment 9, to a top portion 10 of stand 2. In one embodiment, the hollow tube 8 is adjustably rotatable about attachment 9.

Plastic tube 8 includes three sections 11, 12, and 13. The plastic tube 8 has a first open end 14 and a second open end 15. A mechanism 16 for altering the exit path of a ball is illustrated in FIG. 1A as a curved piece of plastic tubing. The curved piece of tubing is open at its two ends; one end includes a fitting 19 adapted to be attached to second end 15 of plastic tube 8. In this embodiment, the rotatable mechanism 16 is infinitely adjustable to provide the exit angle, by simply rotating the mechanism 16 as it engages with the second end 15 of the tube 8.

Figure 1B:
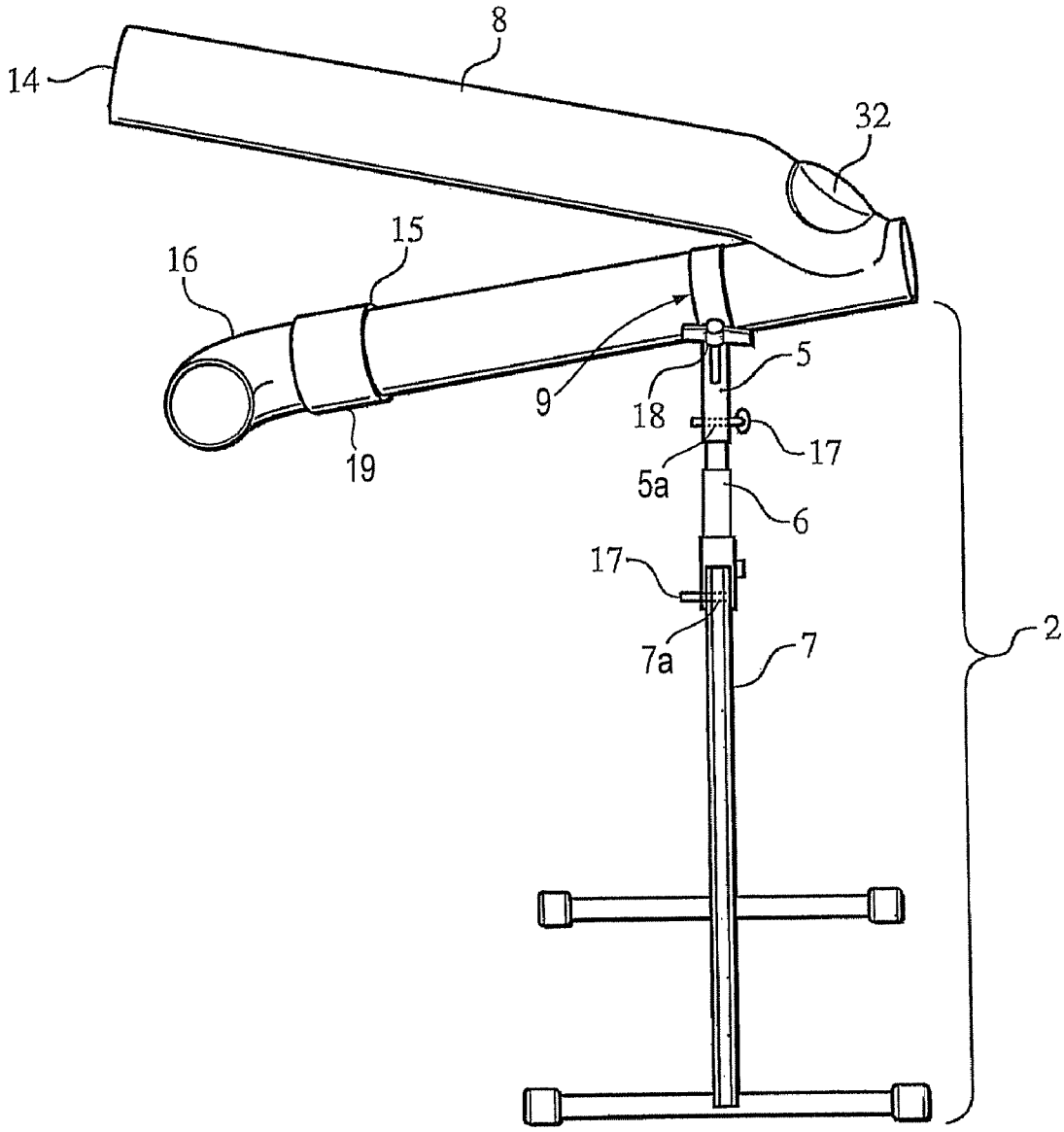
FIG. 1B illustrates a perspective view of another embodiment of a batting aid device.

FIG. 1B illustrates a perspective view of another embodiment of the batting aid device. Telescoping sections 5, 6, and 7 of the stand 2 can be adjusted to a desired height by the use of pins 17 placed through aligned holes 5*a*, 6*a*, and 7*a* in the interlocking sections 5, 6, and 7. Further, adjustment mechanism 7*b* allows for the adjusting of telescoping section 7 relative to leg 3. In one embodiment, adjustment mechanism 7*b* is a tightening mechanism. In addition, FIG. 1B illustrates a dial 18 at the attachment 9 of the stand 2 to the tube 8, which allows the tube 8 to be adjustably rotated such that a ball placed in the tube will travel by force of gravity. FIG. 1B also illustrates the optional feature of an opening 32 in the tube 8. The opening can be positioned at any desired point in the length of the tube. Opening 32 provides an alternative position for feeding balls into the device, for example for a partner to stand clear of the user while loading the device, as well as an alternative position to place a ball holding device such as that illustrated in FIGS. 2A and 2B.

In use, a ball is placed in the first end 14 of the hollow plastic tube 8. The ball travels, by force of gravity, to the second end 15 of the tube, and exits the tube in a path prescribed by the rotatable position of the mechanism 16. The user may then attempt to hit the exiting ball with a stick, bat, or the like. The user may start with and exit angle, ball size, and bat that make it relatively easier to strike the ball, and then vary the angle, bat (e.g. a stick bat), and ball size (e.g. reduce from wiffle baseball to wiffle golf ball) to increase the degree of difficulty.

Figure 2A:
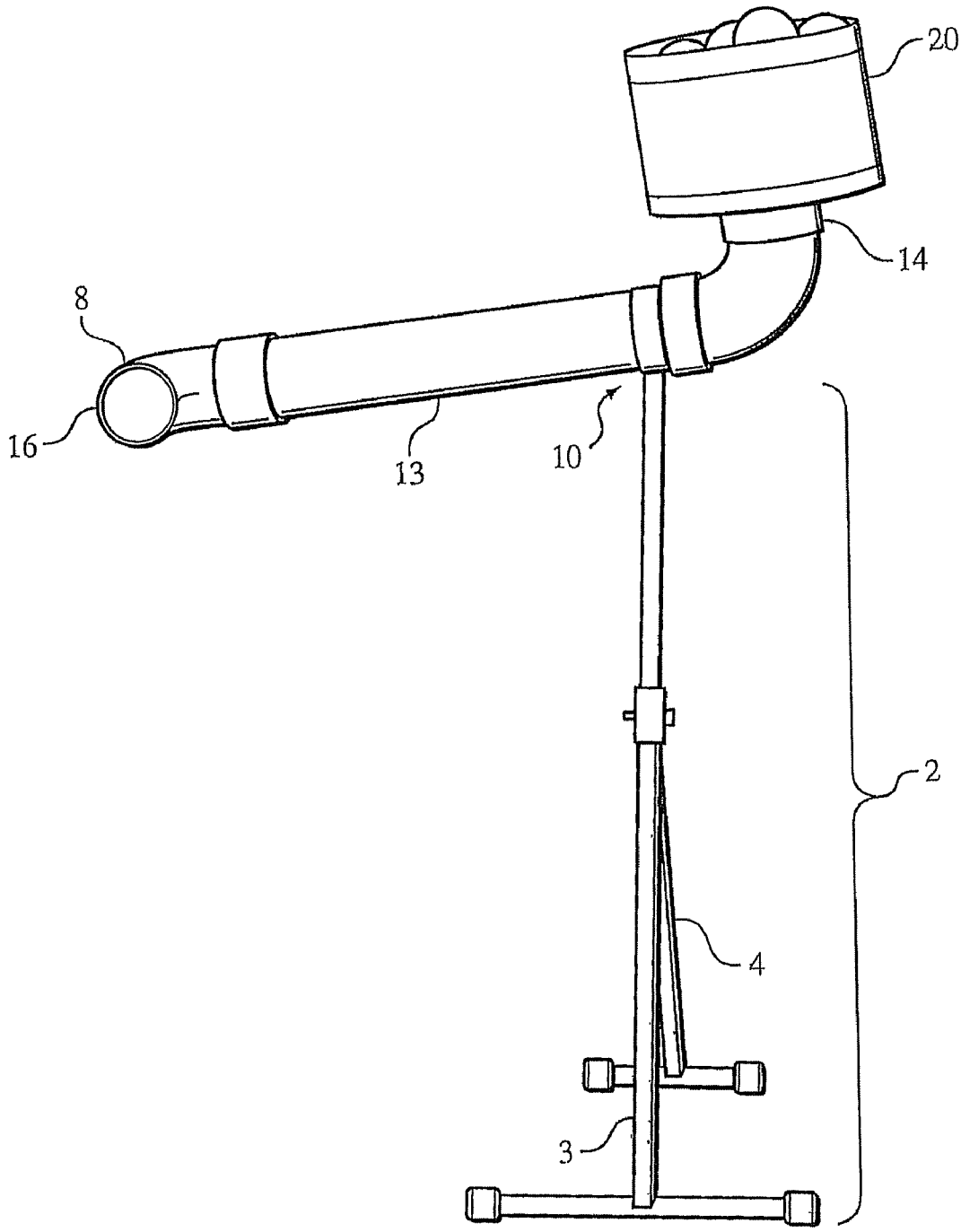
FIG. 2A illustrates a perspective view of one embodiment of a ball holding apparatus.
Figure 2B:
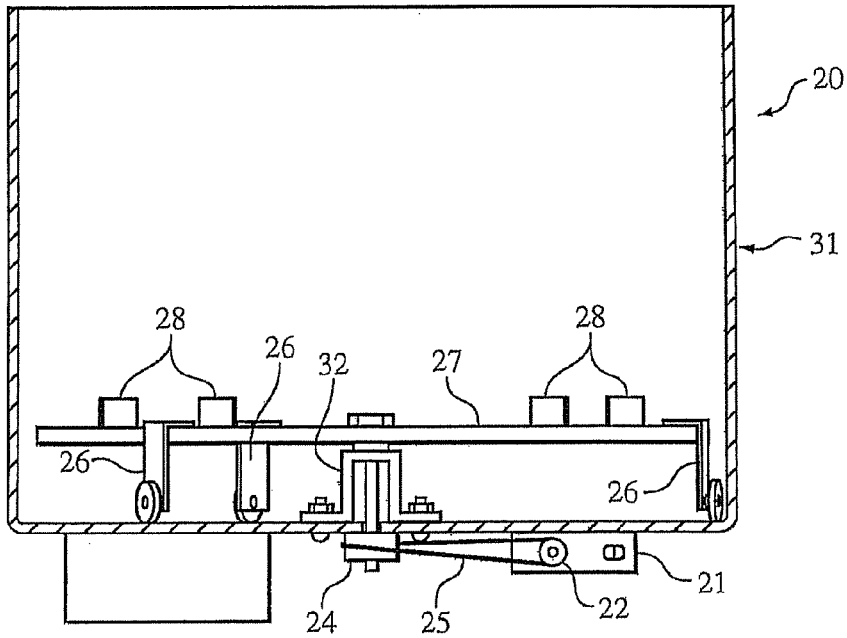
FIG. 2B illustrates a side view of one embodiment of the ball holding apparatus.
Figure 2C:
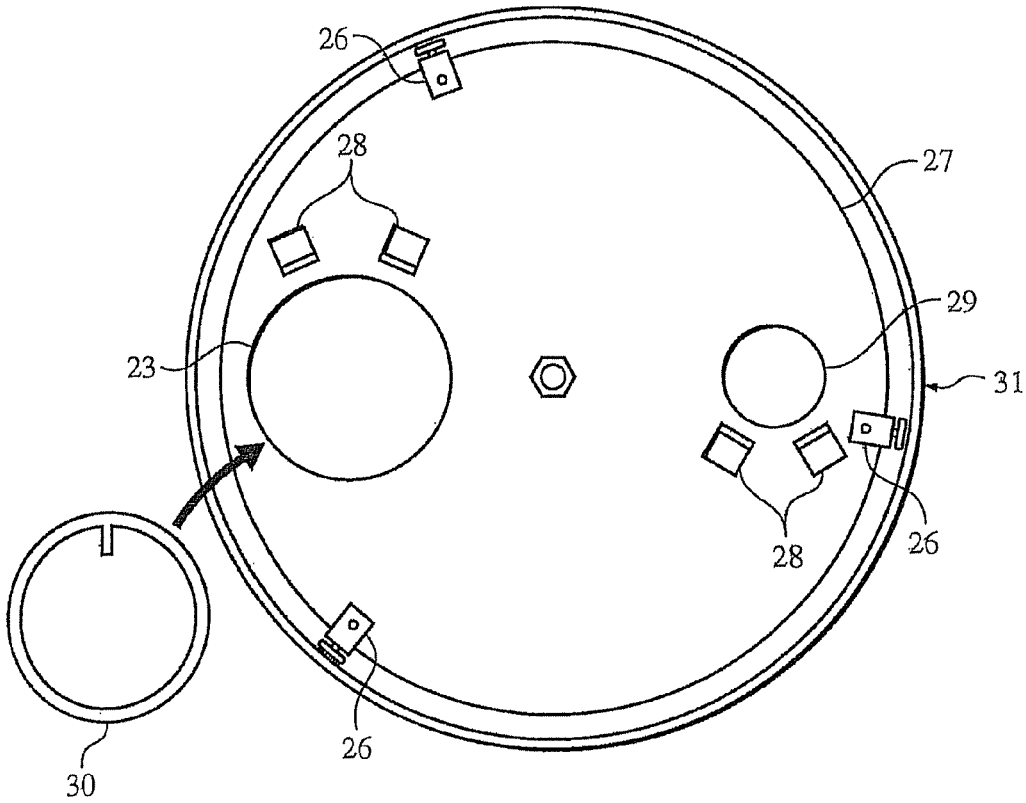
FIG. 2C illustrates a top view of one embodiment of the ball holding apparatus.

FIGS. 2A-2C illustrate another embodiment of the device. The device illustrated in FIG. 2A includes a stand 2 similar to that illustrated in FIG. 1A. The device of FIG. 2A also includes a plastic tube 13 attached to a top portion of the stand 2. The device of FIG. 2A includes the additional feature of a ball holding apparatus 20 attached at the distal end of the plastic tube 13. The ball holding apparatus 20 is capable of holding many balls, and may be attached at any desired position along the length of the tube 13. The ball holding apparatus 20 allows a user to continuously hit one ball after the other after it exits the tube 13 without having to manually load single balls. The ball holding apparatus 20 may be automated to feed balls to the device, or may be a receptacle to store multiple balls for manual loading.

One embodiment of a ball holding apparatus 20 is illustrated in FIG. 2B and FIG. 2C in side and top views, respectively. The elements of the ball holding apparatus 20 are illustrated in detail in FIG. 2B.

In general, the ball holding apparatus 20 includes a plastic bucket 31 containing a plate 27. In one embodiment, plate 27 is metal. Bucket 31 has an opening in its bottom to allow balls to pass through into the tube, and is adapted to fit onto tube 13, e.g. by a collar or other fitting designed to mate with an opening in the tube 13. A motor 21 (e.g., a battery operated motor) that turns plate 27 (by pulleys 22 and 24 and rubber belt 25) and is designed to drop a ball out of the apparatus at a time interval, e.g. about every ten seconds, through a hole 23 in the plate sized to permit passage of a ball of desired diameter.

A vertical pulley 22 on the motor is connected to a horizontal pulley 24 on the partially threaded stud by a rubber belt 25. The rubber belt 25 may be designed to slip to prevent injury resulting from placing a finger or hand into the moving apparatus. The apparatus includes "L" tab with wheels 26 to keep the metal plate 27 balanced and easy to turn. Tabs 28 on the metal plate are designed to drop a ball into a hole and prevent jamming of the balls. The plate may advantageously include multiple holes 23 and 29 sized to generally fit the size of the balls being used in the device, for example three inches for baseball-sized balls and one and a half inches for wiffle golf balls. This feature allows the device to be adaptable for use with differently sized balls. A three-inch cap 30 may be used to plug a three-inch hole 23 when golf ball sized balls are used in the device. A "U" shaped steel bracket 32 may be included, and is designed to allow a ball to partially drop down in the hole, and thereby prevent the ball from easily popping out of a hole.

Figure 3A:
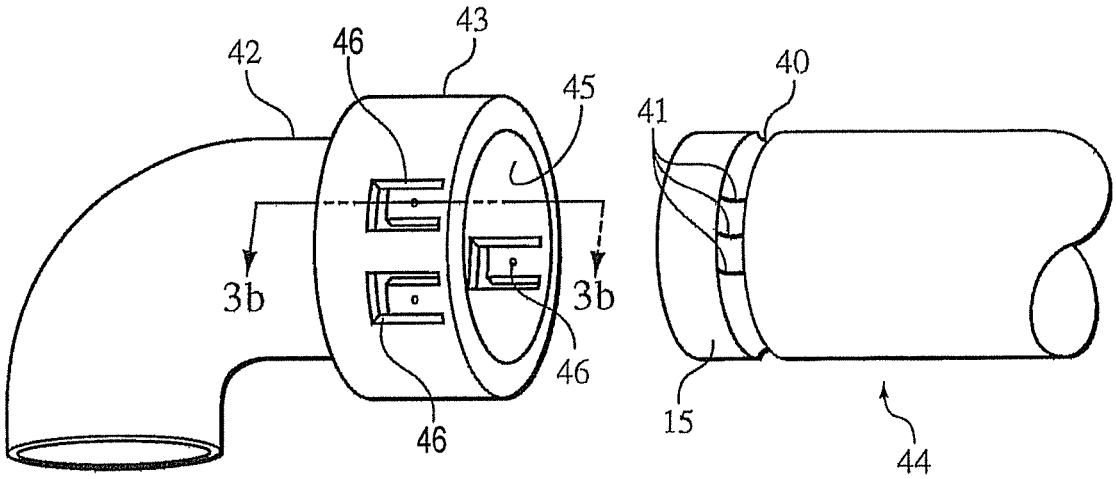
FIG. 3A illustrates a perspective view of one embodiment of a rotatable mechanism.
Figure 3B:
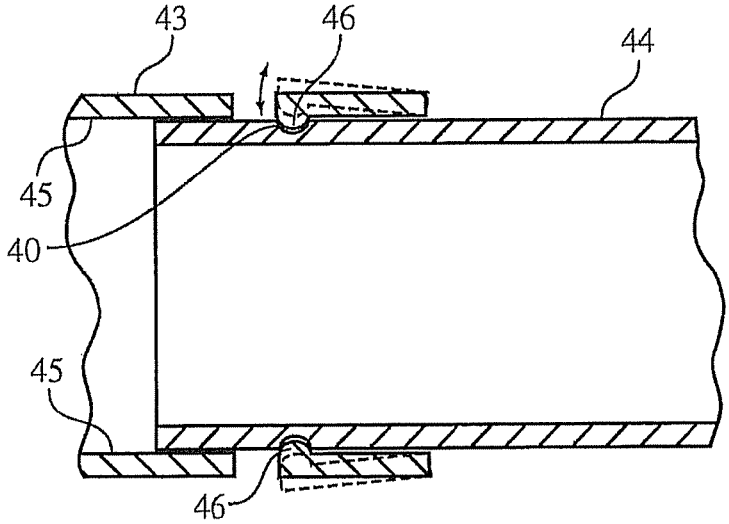
FIG. 3B illustrates a longitudinal cross section of the rotatable mechanism of FIG. 3A.

Additional embodiments feature alternatives to the mechanism 16 for altering the exit path of the ball. FIGS. 3A and 3B illustrate one such alternative. In this embodiment of the device, the second end 15 of the tube has a circumferential recessed groove 40 about at least a portion, and in one embodiment the entirety, of the circumference of the tube near second end 15, wherein the recessed groove contains a plurality of raised portions spaced apart at selected intervals within the groove 40. Rotatable mechanism 42 includes a ring portion 43 for mating with second end 15, and dial portion 44, which is the exit point for a ball. Ring portion 43 has an inner surface 45 and one or more detents 46 on the inner surface 45. As illustrated in FIG. 3A, the ring 43 includes a plurality of generally "U" shaped slots 47, with detents 46 on the inner surface 45 surrounded by the "U"to provide a snapping portion of the ring portion for snapping into the groove. This configuration allows mechanism 43 to snap onto second end 15, by positioning the detent 46 into the groove 40. This snapping action is illustrated in FIG. 3B. Once the mechanism 42 is snapped onto the second end 15, the mechanism can be indexed to a desired distinct position by rotating the mechanism to snap out of and into index positions defined by raised portions 41, thus allowing for adjustment of the exit angel of a ball emerging from second end 15 through the mechanism 42.

Figure 4A:
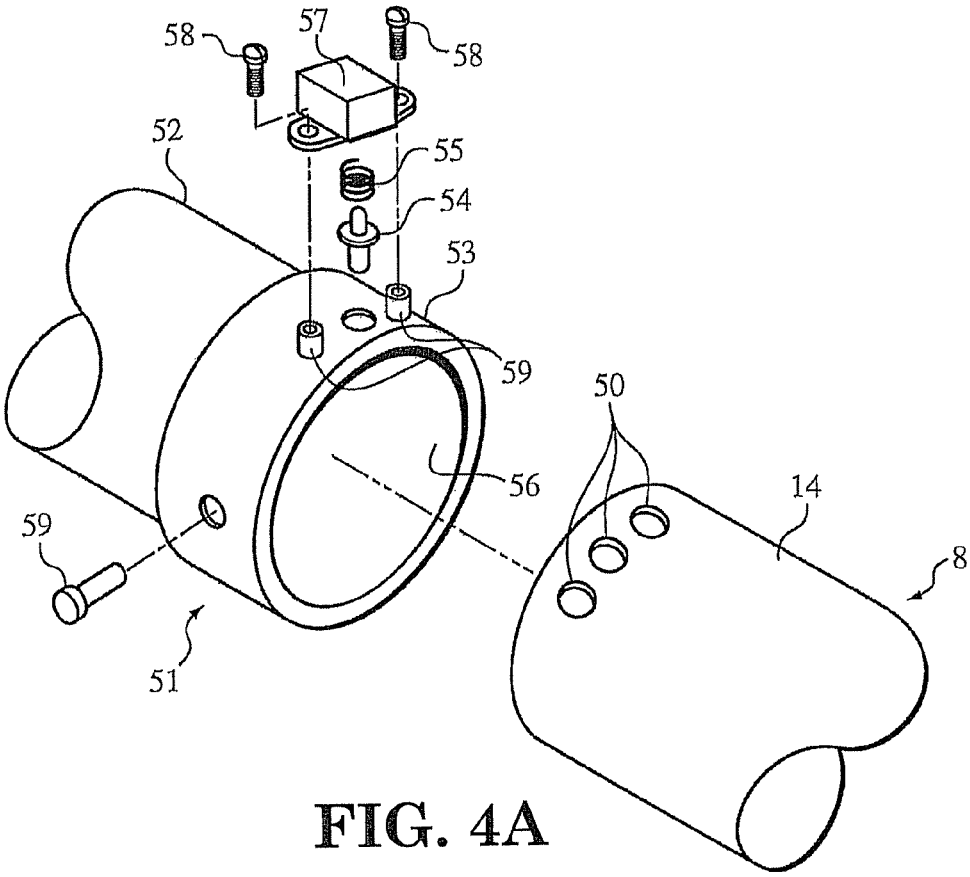
FIG. 4A illustrates a perspective and partially exploded view of one embodiment of a rotatable mechanism.
Figure 4B:
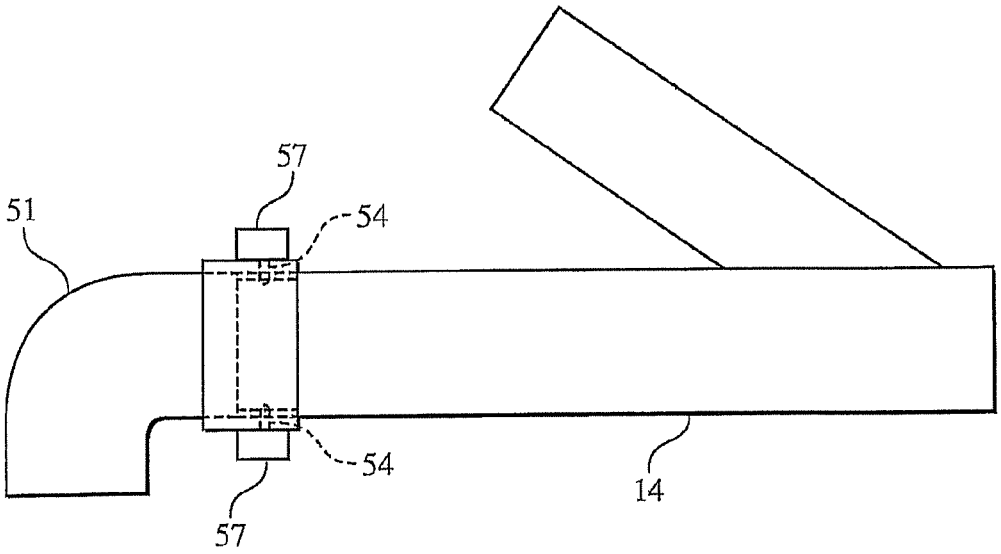
FIG. 4B illustrates a perspective view of the rotatable mechanism of FIG. 4A.

FIGS. 4A and 4B illustrate another embodiment for the mechanism for altering the exit path of the ball. In this embodiment, second end 15 of the device contains a plurality of holes 50 arranged and spaced apart circumferentially near the second end 15 of the tube 8. Rotatable mechanism 51 contains a dial end portion 52 and a ring portion 53, and at least one spring loading pin 54 and spring 55 (illustrated in exploded view in FIG. 4A), wherein the spring loading pin 54 is adapted to be fastened to the ring portion 53. The spring loading pin 54 extends through and protrudes from the inner surface 56 of the ring portion 53, and is adapted to engage with the holes 50 in second tube end 15 with the ring portion 53 placed over the second end 15. The spring loading pin 54 is further adapted to move out of and into holes 50 as the mechanism 51 is rotated to index the mechanism at a desired position that will provide a desired exit path for a ball emerging from the mechanism 51.

In the embodiment illustrated in FIG. 4A, a housing 57 covers the spring loading pin 54 and spring 55 and is attached with screws 58 to the ring portion 53 at 60. In the embodiment illustrated in FIG. 4B, there are two spring loading pins 54 in the mechanism 51. As illustrated in FIG. 4A, the mechanism 51 may be comprised of separate ring 53 and dial end portion 52, with the ring 53 attached to the dial end portion 52 by one or more pivot pins 59. In this embodiment, the device would be assembled by attaching the ring 53 (containing the spring leading pin(s) 54 for indexing) to the dial end 52 by engaging the pivot pin(s) 59 with holes in the ring 53. The mechanism 51 comprising the dial end 52 and ring 53 is then placed over the second end 15 of the tube 8 such that the spring loading pin(s) engage with holes 50. The mechanism 51 can then be rotated and locked into desired distinct positions for determining the exit path of the ball.

In one embodiment, the devices are used in conjunction with a stepwise hitting process to develop hand-eye coordination and a quicker swing for hitting a baseball or softball. In general, a stepwise hitting process may include steps in which parameters of the process are varied. Parameters of the process that may be varied include the type of instrument (baseball bat, stick bat), the size of the ball (baseball-size, golf ball size), and the exit path of the ball (substantially directly toward the user, e.g. a generally horizontal exit path; at an angle, e.g. 45 degrees; and substantially straight down or vertical).

In general, the method involves increasing the degree of difficulty of hitting the ball with each step, by varying at least one parameter of the process, with the end result being improvement in hand-eye coordination and swing speed. For example, a first step may include using a baseball bat to hit wiffle baseballs as the balls come toward the user; a second step may include using a stick bat to hit wiffle baseballs coming toward the user; a third step and fourth step may repeat the first step and second step using wiffle golf balls. These four steps may then be repeated with the ball exiting the device at a forty-five degree angle, and repeated again with the ball dropping straight down.

An example of a twelve step hitting process that can be used in conjunction with embodiments of the device is as follows:

Step 1. Use a baseball bat to hit wiffle baseballs as the balls come toward you.

Step 2. Use a stick bat to hit wiffle baseballs as the balls come toward you.

Step 3. Use a baseball bat to hit wiffle golf balls as the balls come toward you.

Step 4. Use a stick bat to hit wiffle golf balls as the balls come toward you.

Step 5. Use a baseball bat to hit wiffle baseballs as the balls come at 45-degree angle.

Step 6. Use a stick bat to hit wiffle baseballs as the balls come at 45-degree angle.

Step 7. Use a baseball bat to hit wiffle golf balls as the balls come at 45-degree angle.

Step 8. Use a stick bat to hit wiffle golf balls as the balls come at 45-degree angle.

Step 9. Use a baseball bat to hit wiffle baseballs as the balls drop straight down.

Step 10. Use a stick bat to hit wiffle baseballs as the balls drop straight down.

Step 11. Use a baseball bat to hit wiffle golf balls as the balls drop straight down.

Step 12. Use a stick bat to hit wiffle golf balls as the balls drop straight down.

Figure 5:
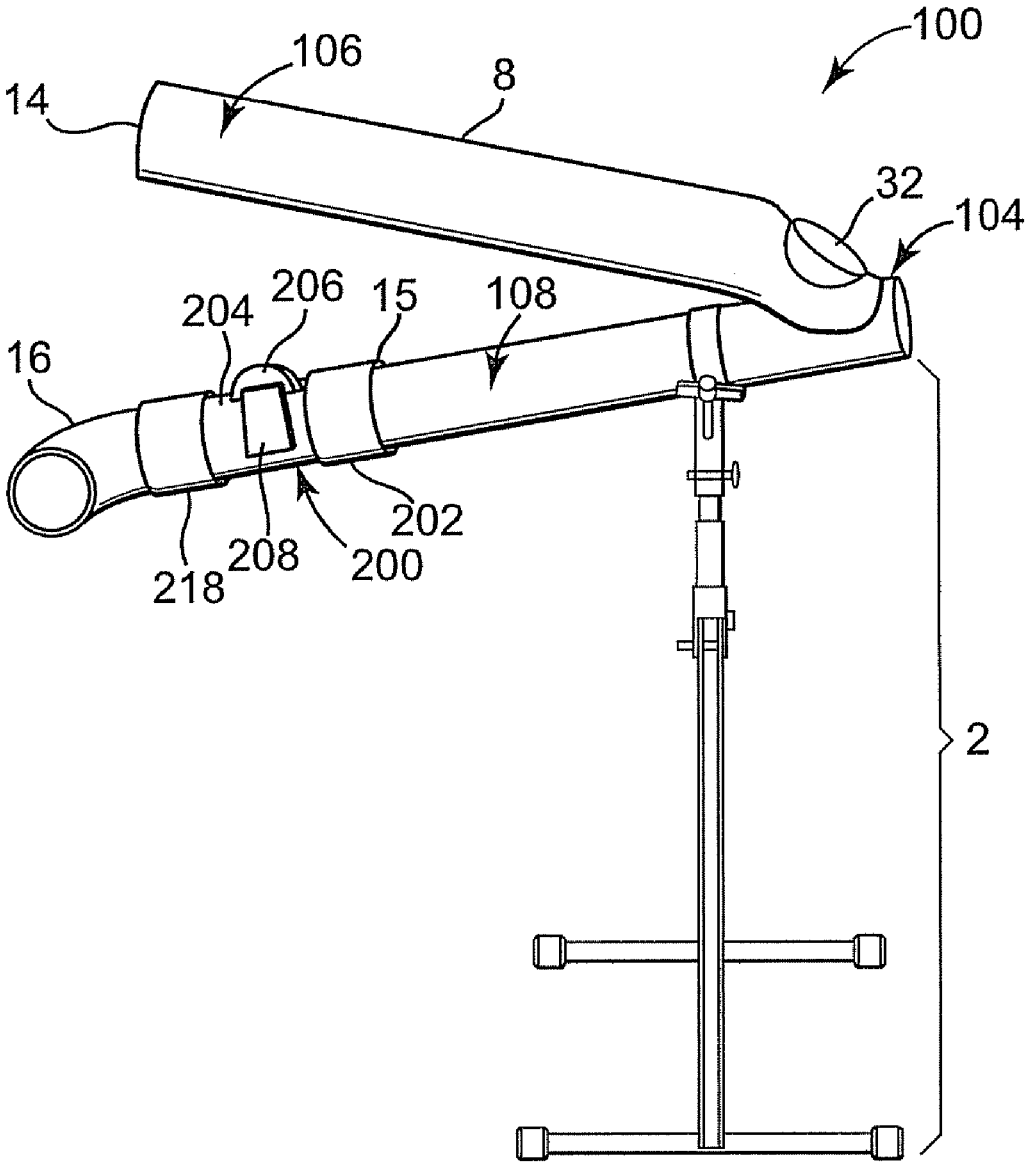
FIG. 5 illustrates a perspective view of one embodiment of a batting aid device with an automatic feed mechanism.

FIG. 5 illustrates a perspective view of one embodiment of a batting aid device 100. Batting aid device 100 is similar to batting aid device 1 described above with respect to FIGS. 1A and 1B except for those differences enumerated herein. Batting aid device 100 includes substantially "V" shaped hollow tube 8 defining a vertex 104, a first length 106, and a second length 108. Hollow tube 8 is fully enclosed and has a substantially circular cross-sectional shape. First length 106 extends between first open end 14 and vertex 104, and second length 108 extends between vertex 104 and second open end 15. In one embodiment, opening 32 is defined in the first length 106 relatively near vertex 104 as compared to first open end 14.

Hollow tube 8 is coupled with stand 2 or any other suitable stand configured to maintain hollow tube 8 above a batting zone of a batter using batting aid device 100. In one example, hollow tube 8 is alternatively coupled with a tripod stand.

Hollow tube 8 is positioned on stand 2 such that first length 106 is angled downward (i.e. towards the ground or other support surface) as first length 106 extends from first open end 14 toward vertex 104. Second length 108 is positioned to be angled downward from vertex 104 toward second open end 15. In this manner, hollow tube 8 is configured to utilize gravitational forces to move balls through hollow tube 8, more particularly, from first open end 14 or opening 32 to vertex 104 and from vertex 104 to second open end 15.

In one embodiment, batting aid device 100 includes a feed mechanism 200. Feed mechanism 200 is coupled with second end 15 of hollow tube 8 and is configured to regulate the movement of balls through and delivery of balls from batting aid device 100. In one embodiment, second end 15 of hollow tube 8 defines a connection cuff 202 to facilitate attachment of feed mechanism 200 thereto. In particular, connection cuff 202 extends about an outer surface of second end 15 and is configured to receive a portion of feed mechanism 200, as will be further described below. In one example, connection cuff 202 is configured to extend around an end of feed mechanism 200 to couple feed mechanism 200 to hollow tube 8 by friction fit or other suitable method of attachment. In one embodiment, connection cuff 202 may employ similar means of attachment with feed mechanism 200 as described with respect to rotatable mechanism 42 in FIGS. 3A and 3B and/or with respect to rotatable mechanism 51 in FIGS. 4A and 4B. Although primarily described herein as being a separate accessory for use with hollow tube 8, in one embodiment, feed mechanism 200 is formed as an integral part of hollow tube 8 at any location along second length 108 of hollow tube 8.

Exit mechanism 16 is configured to be coupled with feed mechanism 200 opposite second open end 15 of hollow tube 8 to define an exit angle of a ball from batting aid device 100. In one embodiment, automatic feed mechanism 200 is selectively coupled with hollow tube 8 and can be removed from hollow tube 8 if desired by the user. In one embodiment, upon removal of automatic feed mechanism 200 from hollow tube 8, exit mechanism 16 can be removed from automatic feed mechanism 200 and coupled with second end 15, more particularly with connection cuff 202, of hollow tube 8.

Figure 6A:
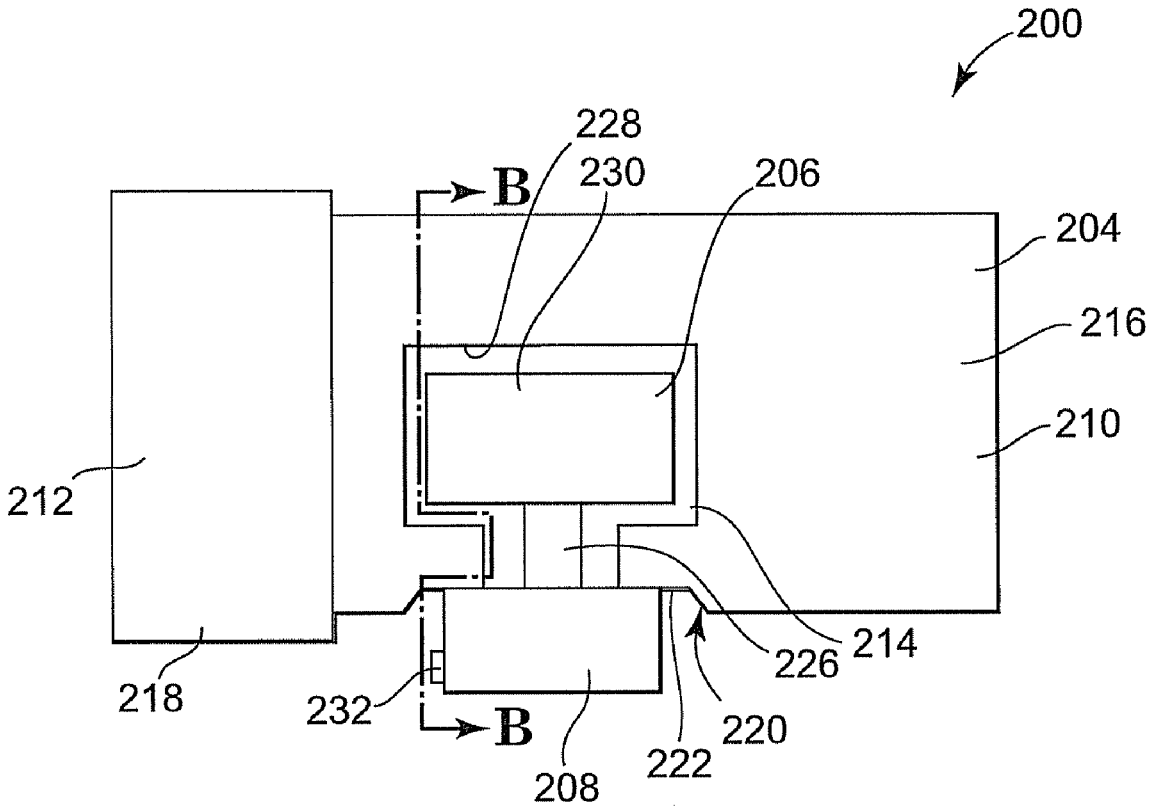
FIG. 6A illustrates a top view of the automatic feed mechanism of FIG. 5.
Figure 6B:
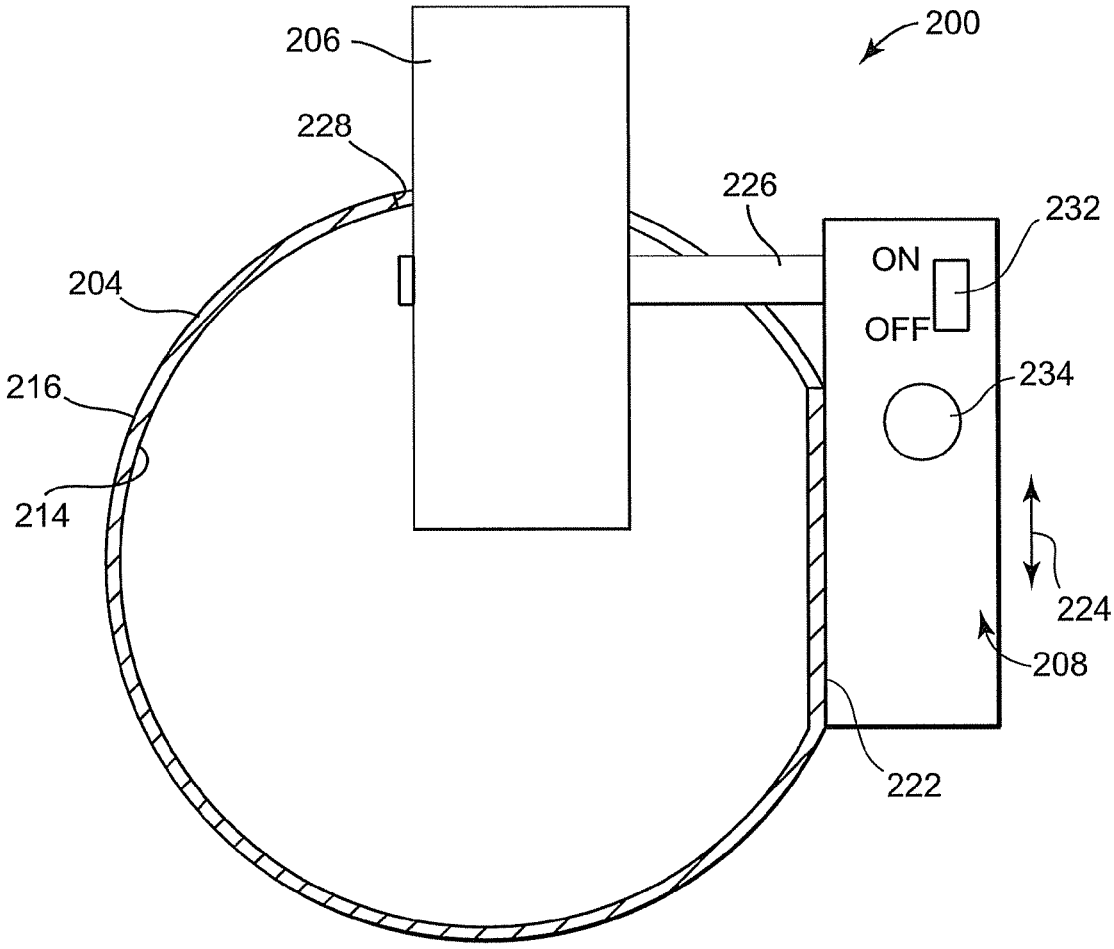
FIG. 6B illustrates a cross-sectional view of FIG. 6A taken along the line B-B.

FIGS. 6A and 6B illustrate one embodiment of feed mechanism 200 including a tubular member 204, a wheel 206, and a motor 208. In one embodiment, tubular member 204 has a circular cross-sectional shape and defines an internal diameter similar to an internal diameter defined by hollow tube 8 (FIG. 5). Tubular member 204 is generally elongated so as to define a first end 210, a second end 212 opposite first end 210, an interior surface 214, and an exterior surface 216 opposite interior surface 214.

In one embodiment, second end 212 includes a connection cuff 218 configured to receive and facilitate selective attachment of exit mechanism 16 with feed mechanism 200. Connection cuff 218 extends about outer surface 214 near second end 212 and extends past second end 212 defining an internal cavity having a larger diameter than a diameter of an external cavity defined by the remainder of tubular member 204. Accordingly, connection cuff 218 is configured to extend around exit mechanism 16 to be coupled with exit mechanism 16 by friction fit or other suitable method of attachment. In one embodiment, connection cuff 218 may employ similar means of attachment with exit mechanism 16 as described with respect to rotatable mechanism 42 in FIGS. 3A and 3B and/or with respect to rotatable mechanism 51 in FIGS. 4A and 4B.

Wheel 206 is mounted to tubular member 204 via motor 208. In one embodiment, tubular member 204 includes an indentation 220 configured to provide a substantially planar outer surface 222 for receiving motor 208. Motor 208 may be coupled with outer surface 222 in any suitable method. In one example, motor 208 is coupled with outer surface 222 in a manner permitting adjustment of the position of motor 208 relative to tubular member 204 in the direction generally indicated in FIG. 6B with arrow 224. In one embodiment, a planar plate (not illustrated) is coupled with tubular member 204, and motor 208 is slidably coupled with the planar plate.

In one embodiment, an axle 226 extends from motor 208 toward tubular member 204 with a substantially perpendicular orientation. Motor 208 is configured to rotate axle 226 about a longitudinal axis of axle 226. Axle 226 extends from motor 208 into tubular member 204 through an aperture 228 formed in tubular member 204. In one embodiment, aperture 228 is substantially "T" shaped due to the curvature of the wall of tubular member 204 and to accommodate transition of axle 226 and wheel 206 into tubular member 204. In one embodiment, aperture 228 alternatively defines any other suitable shape.

Wheel 206 is coupled with axle 226 opposite motor 208 and is positioned to extend through aperture 228 so as to be maintained partially inside and partially outside tubular member 204. In particular, wheel 206 is mounted such that the rotation of axle 226 rotates wheel 206 about a rotational axis of wheel 206. In this manner, wheel 206 is positioned such that the rotational axis extends substantially perpendicular to the longitudinal extension of tubular member 204. Due to the coupling of axle 226 and wheel 206, as motor 208 drives rotation of axle 226, motor 208 inherently drives rotation of wheel 206 as well.

In one embodiment, wheel 206 defines a circumferential surface 230 configured to contact balls traveling through batting aid device 100. In one example, wheel 206 has a thickness of approximately 2 inches and a diameter of between approximately 5 inches and approximately 5.5 inches. Wheel 206 is formed of a formable and at least partially elastic material, such as foam, a polymeric material, etc. Wheel 206 is configured to deform upon contact with a ball supported by internal surface 214 of tubular member 204 and to reform to the original shape when wheel 206 no longer contacts a ball 240. In one embodiment, the amount wheel 206 deforms during use depends on the size of a ball passing through tubular member 204.

Since motor 208 is coupled with wheel 206 via axel 226, movement of motor 208 in direction 224 also moves wheel 206 in direction 224. In one embodiment, motor 208 is configured to be moved to a variety of positions each corresponding with a particular ball size. In one example, tubular member 204 includes indicias indicating a position setting of motor 208 that corresponds with one or more balls sizes, such as, baseball setting, a softball setting, a golf ball setting, etc. Accordingly, during use the position of wheel 206 relative to tubular member 204 is adjusted depending upon the particular size of balls being used therewith. In particular, wheel 206 is generally lowered (i.e. moved further within tubular member 204) for use with smaller balls and raised for use with larger balls as needed.

In one embodiment, motor 208 includes an on/off switch 232 configured to selectively activate and de-activate motor 208 from rotating axle 226 and wheel 206. In one embodiment, motor 208 is configured to rotate wheel 206 at one of a variety of speeds such that a time interval or spacing between delivery of balls through batting aid device 100 can be adjusted. As such, motor 208 may include a speed control button or dial 234. In one embodiment, motor 208 is configured to advance balls through tubular member 204 with a time interval of between approximately 5 seconds and approximately 8 seconds between each ball delivered from tubular member 204. The time interval is configured to allow a batter using batting aid device 100 to ready themselves between the delivery of a ball from batting aid device 100.

Figure 7A:
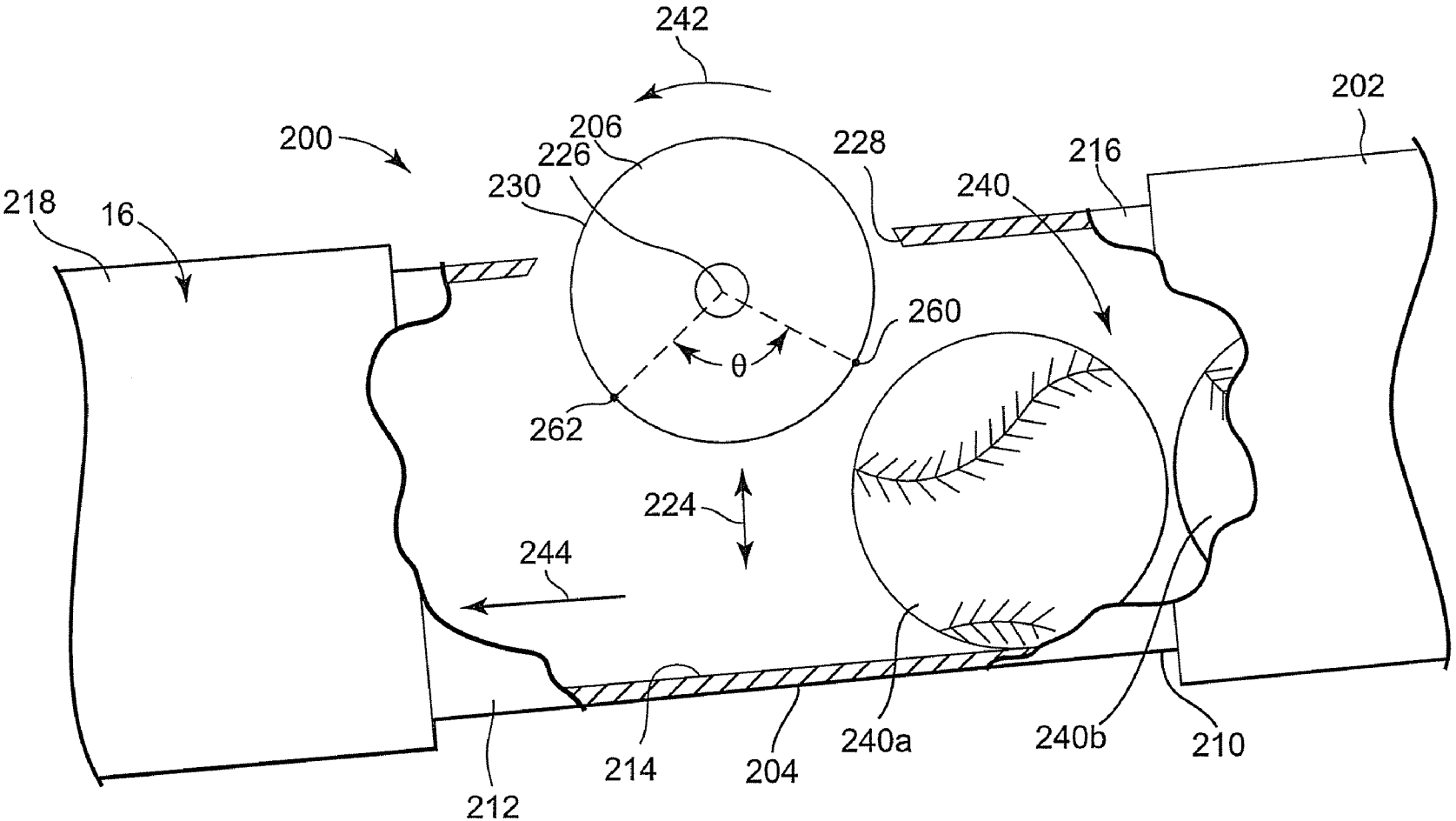
FIG. 7A illustrates one embodiment of a batting aid device with an automatic feed mechanism in a first use position.
Figure 7B:
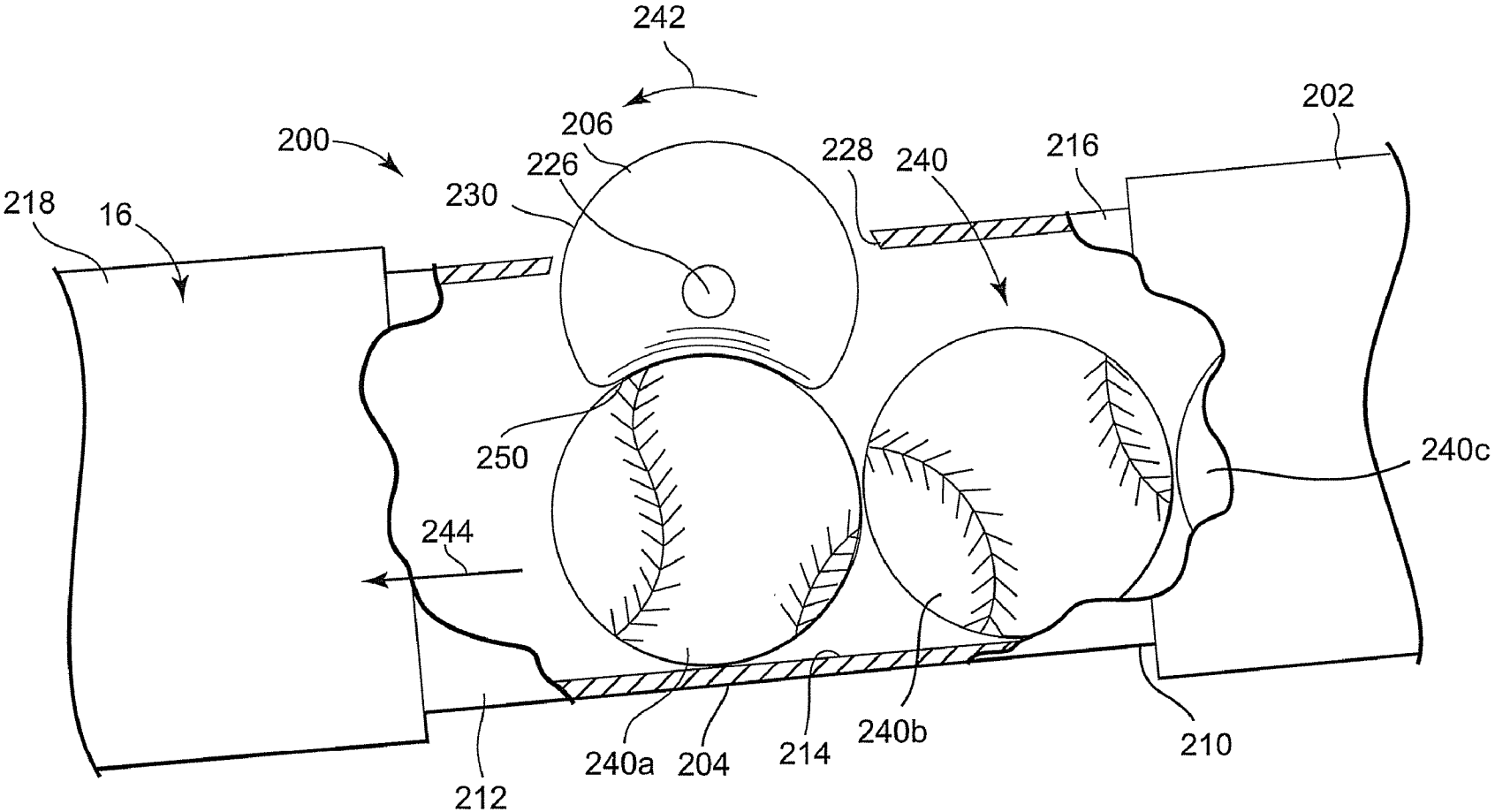
FIG. 7B illustrates one embodiment of the batting aid device with the automatic feed mechanism of FIG. 7A in a second use position.
Figure 7C:
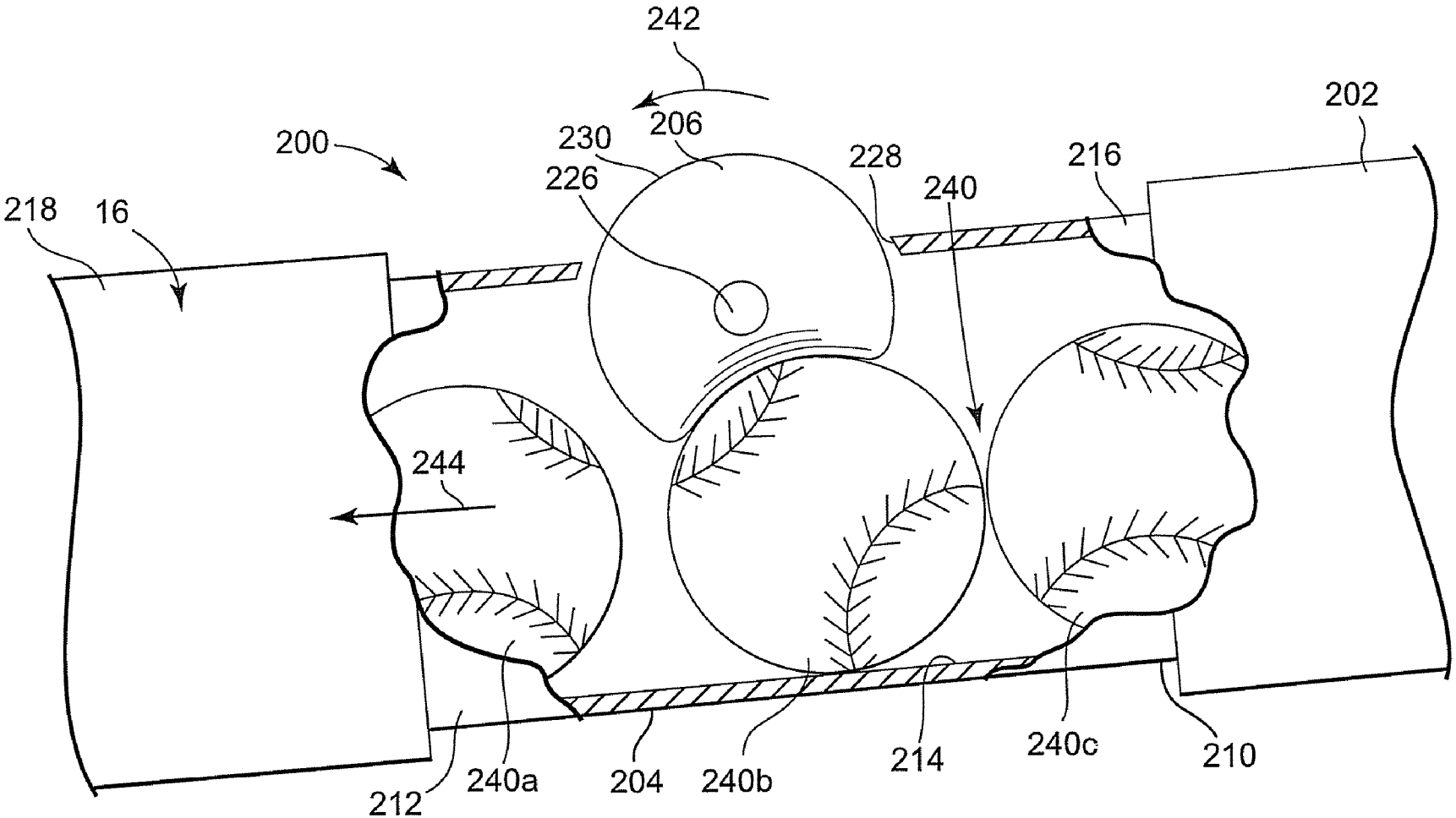
FIG. 7C illustrates one embodiment of the batting aid device with the automatic feed mechanism of FIG. 7A in a third use position.

FIGS. 7A-7C illustrate automatic feed mechanism 200 coupled with release mechanism 16 during use. In particular, FIGS. 7A, 7B, and 7C respectively illustrate wheel 206 in a first, second, and third use position. As illustrated in FIG. 7A, when motor 208 is in the off position, wheel 206 is maintained in a stationary position. Prior to use, in one embodiment, motor 208 is adjusted in direction 224 as necessary depending upon the size of balls 240 that will be used. In particular, motor 208 is positioned lower for smaller balls 240 and higher for larger balls 240.

After wheel 206 is positioned, balls 240 are inserted or fed into hollow tube 8 (FIG. 5) via first open end 14 and/or via intermediate opening of tubular member 204. Wheel 206 generally remains stationary as balls 240 are inserted into hollow tube 8. As such, stationary wheel 206 acts as a stop generally preventing the advancement of balls 240 past wheel 206.

More specifically, the angled nature of lengths 106 and 108 of hollow tube 8, gravity causes each ball 240 to roll through hollow tube 8 from first open end 14 or opening 32 and into feed mechanism 200. A first ball 240*a* moves through feed mechanism 200 until first ball 240*a* contacts and is stopped by stationary wheel 206. Notably, when in the stationary position, wheel 206 extends down into tubular member 204 from aperture 228 a sufficient distance to substantially prevent advancement of balls 240 past wheel 206. Each subsequent ball 240*b*, 240*c*, etc. moves through hollow tube 8 and/or feed mechanism 200 until each ball 240*b*, 240*c*, etc. contacts and is stopped by an adjacent ball 240 that has already been stopped within hollow tube 8 or feed mechanism 200. Referring to FIG. 5, in one embodiment, balls 240 are fed into hollow tube 8 until the desired number of balls 240 are maintained within hollow tube 8. In one example, hollow tube 8 is loaded with up to twelve baseball sized balls 240. Upon activation of motor 208 (FIGS. 6A and 6B), wheel 206 is configured to rotate as generally indicated by arrow 242 to grasp, advance, and release balls 240 toward exit mechanism 16 in the direction generally indicated by arrow 244.

For example, turning to FIG. 7B, upon interaction with first ball 240*a*, wheel 206 deforms due to a force of interaction with first ball 240*a* as supported by interior surface 214 of tubular member 204. More specifically, wheel 206 deforms inward toward the center of wheel 206 to form a concave reception area 250 for receiving ball 240*a*. As wheel 206 is subsequently rotated as illustrated in FIG. 7B, the deformation of wheel 206 about first ball 240*a* coupled with rotation of wheel 206 causes wheel 206 to advance first ball 240*a* through tubular member 204 in direction 244. As ball 240*a* is rotated via wheel 206, subsequent balls 240 such as balls 240*b*, 240*c*, etc. are also moved through hollow tube 8 and/or tubular member 204 due to the force of gravity and the angled nature of hollow tube 8 and tubular member 204. Continued rotation of wheel 206 further causes ball 240*a* to be advanced toward release mechanism 16.

Upon rotation of wheel 206 to an appropriate position, wheel 206 releases ball 240*a* as generally indicated in FIG. 7C. Released ball 240*a* is pulled by gravity through exit mechanism 16 and is released from batting aid device 100. Upon release of first ball 240*a*, the elastomeric nature of wheel 206 causes wheel 206 to at least partially reform to the original shape of wheel 206, and wheel 206 continues to rotate and contacts and deforms to next ball 240*b*. In one embodiment, wheel 206 may contact second ball 240*b* prior to release of first ball 240*a*. In this respect, wheel 206 continually advances balls 240*a* and 240*b* toward release mechanism 16 and prevents balls 240 from freely falling from batting aid device 100 with little or no time interval therebetween. In one embodiment, wheel 206 contacts and rotates each ball 240 through a rotation angle θ defined between a first point of contact 260 and a last point of contact 262 between ball 240 and wheel 206 as generally indicated in FIG. 7A. Rotation angle θ is dependent upon the size/type of ball 240 and the position of motor 208 and wheel 206. In one embodiment, rotation angle θ is between 35° and 80°.

Wheel 206 not only serves to substantially prevent the unwanted advancement of balls 240 through batting aid device 100, but wheel 206 also serves to regulate the speed of release of balls 240 from batting aid device 100 to a batter. In this respect, an individual batter may turn off motor 208 and load hollow tube 8 with a series of balls 240. When batter is prepared to swing at or attempt to contact balls 240, motor 208 is activated or turned on, and the series of balls 240 begin to be released from batting aid device 100, more particularly, in one embodiment, from release mechanism 16. Due to use of feed mechanism 200, the series of balls 240 are released one at a time with a spacing interval configured to provide the batter with sufficient time to reset and swing at each ball 240 as it is released from batting aid device 100. In one embodiment, the speed at which wheel 206 is rotated is adjustable to vary the spacing interval between release of adjacent balls 240.

Although described above as being used with release mechanism 16, in one embodiment, no release mechanism 16 is utilized and balls 240 are dropped directly from second end 212 of feed mechanism 200. In one embodiment, feed mechanism 200 is configured to regulate the advance of a plurality of sizes of balls 240, such as softballs, baseballs, golf balls, etc. In one embodiment, feed mechanism 200 is selectively coupled to batting aid device 100 such that feed mechanism 200 can be removed from the remainder of batting aid device 100 if so desired. Furthermore, release mechanism 16 can then be attached to second end 15 of hollow tube 8 as desired by user. In another embodiment, feed mechanism 200 may be formed as a permanent part of or within hollow tube 8 as will be apparent to those of skill in the art.

Figure 8:
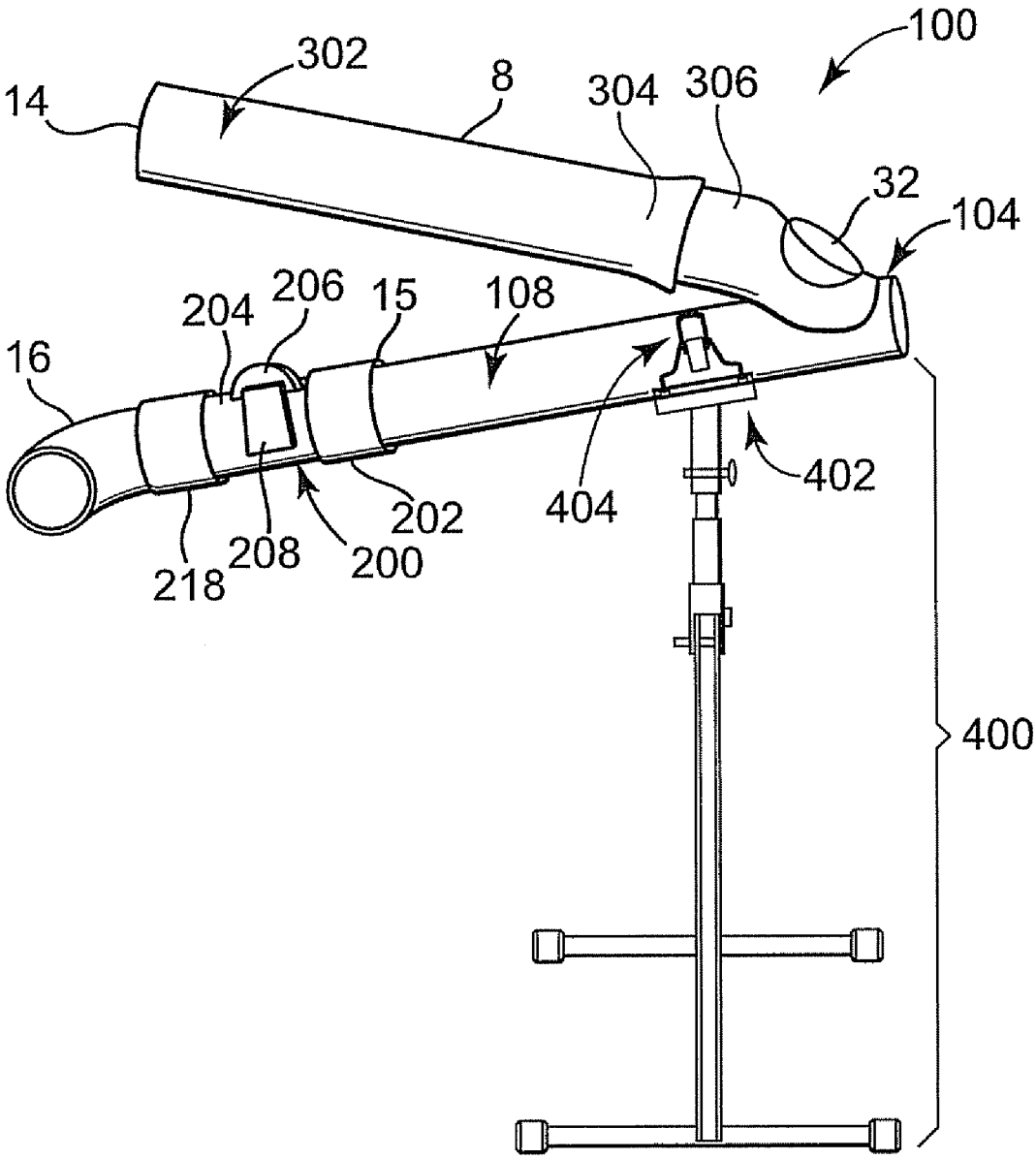
FIG. 8 illustrates one embodiment of a batting aid device with an automatic feed mechanism.

FIG. 8 illustrates one embodiment of a batting aid device 300 similar to batting aid device 100 except for the differences enumerated herein. In one embodiment, a first length 302 of batting aid device 300 similar to first length 106 is formed of two separate and couplable pieces. More specifically, in one embodiment, first length 302 includes a first section 304 and a second section 306, which are separately formed from one another. First section 304 includes first end 14 and second end extends from vertex 104. In one example, a portion of second section 306 fits within first section 304 to selectively couple sections 304 and 306 to collectively define first length 302.

Figure 9:
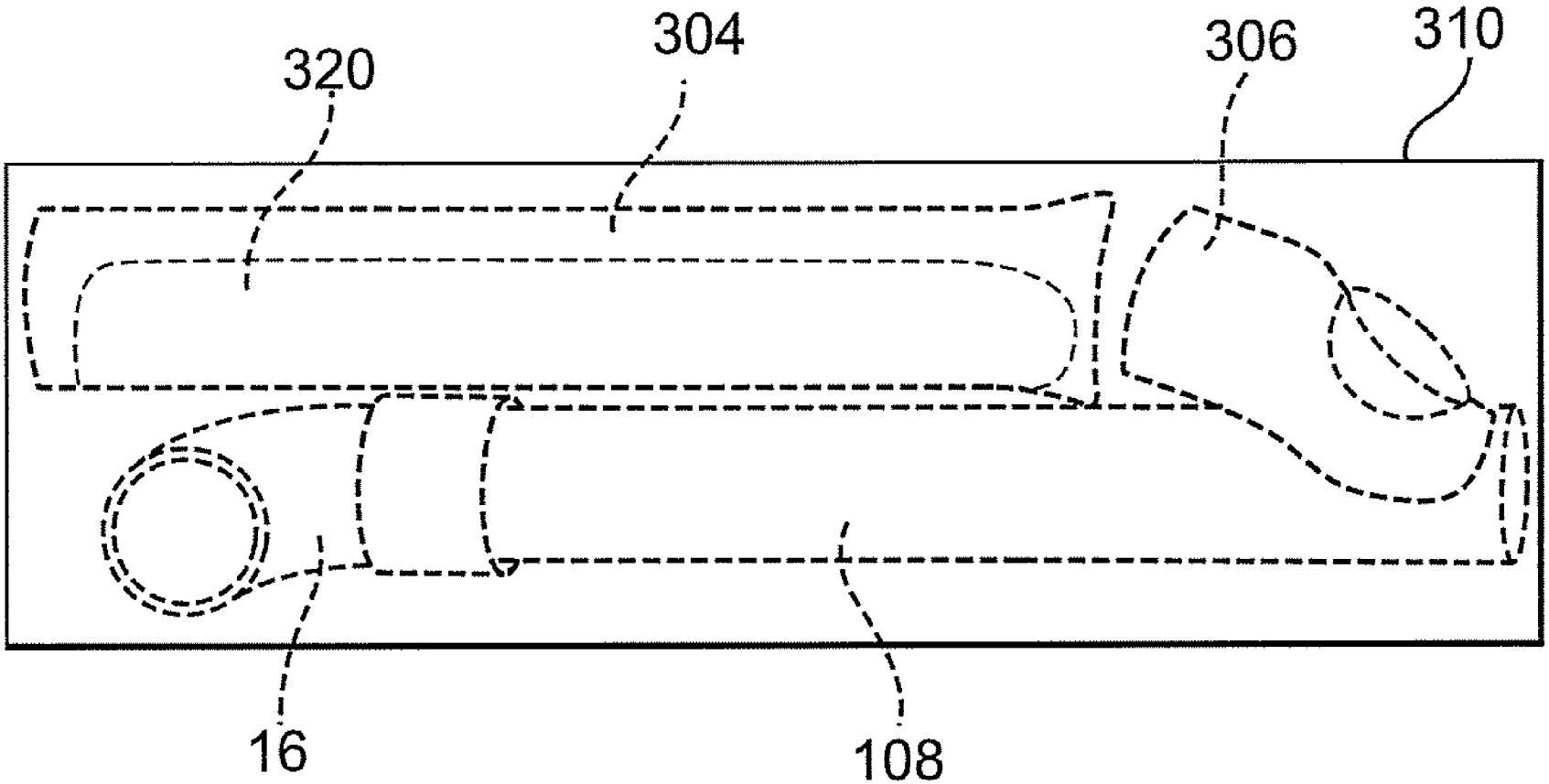
FIG. 9 illustrates one embodiment of a batting aid device in a container.

Additionally referring to FIG. 9, formation of first length 302 in two sections 304 and 306 facilitates placement of batting aid device 300 into a box or other container 310 for storage and/or transport that is smaller than a container that would otherwise be required to house hollow tube 8 formed as a single piece. In particular, first section 304 is removed from second section 306 and placed adjacent second length 108 of hollow tube 8. As such, in one example, an elongated rectangular container 310 is used. Second length 108 can be stored with one or both of feed mechanism 200 (FIG. 8) and/or exit mechanism 16. To further limit the size of container 310, in one embodiment, stand 2 (FIG. 5) or other suitable stand is collapsed and stored within first section 304 of first length 302 or within second length 108 as generally indicated in FIG. 9 at 320.

Figure 10:
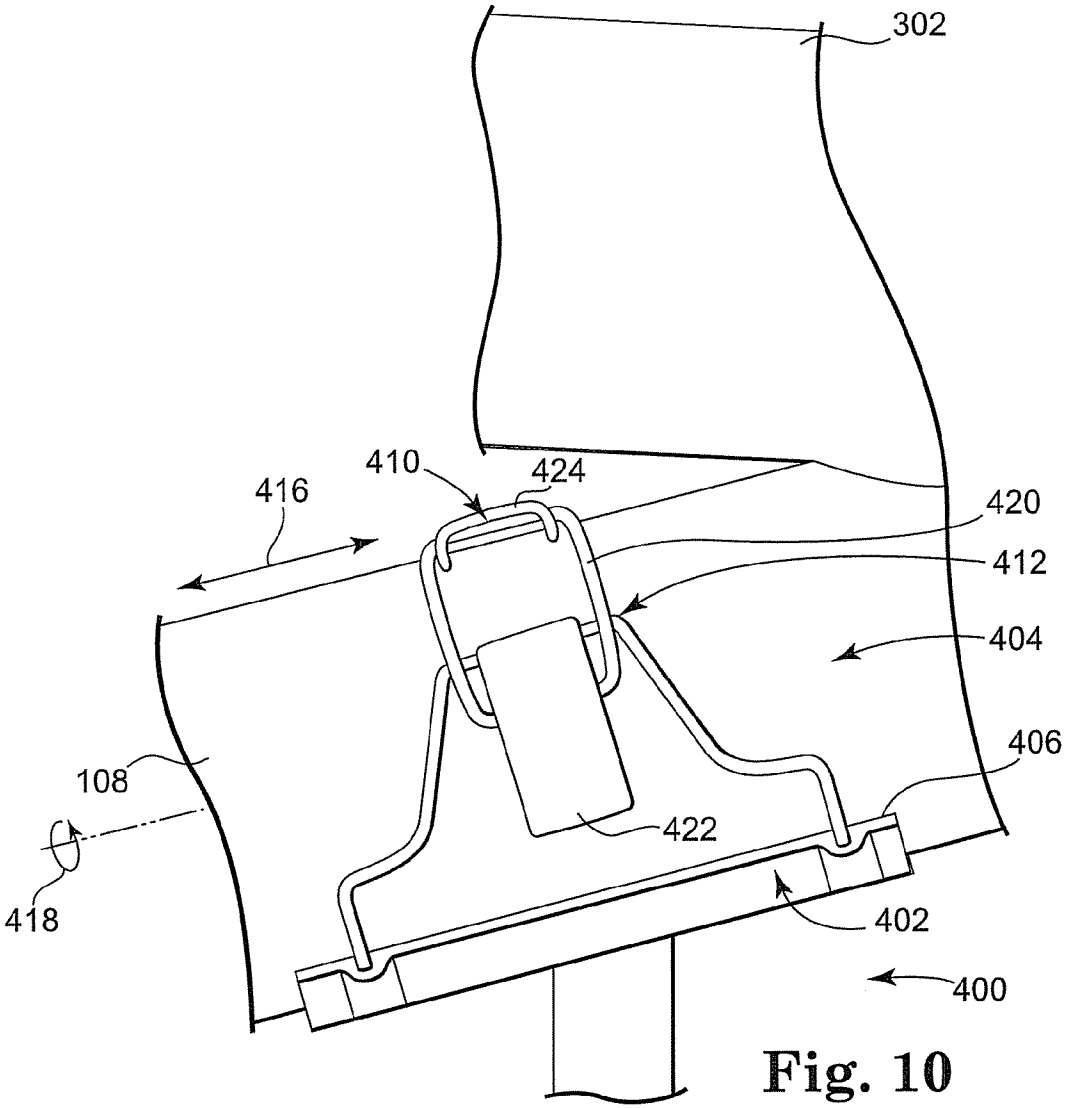
FIG. 10 illustrates one embodiment of a coupling portion of a stand of the batting aid device of FIG. 8.

Referring to FIG. 8 and the enlarged illustration of FIG. 10, in one embodiment, an alternate stand 400 is used to support hollow tube 8. Stand 400 is similar to stand 2 or is any other suitable stand having the particular features described herein. FIG. 10 more particularly illustrates one embodiment of a coupling portion of stand 400 including a cradle 402 at a topmost portion thereof and a locking device 404. Cradle 402 defines an elongated member with a generally curvilinear cross-sectional shape and is configured to receive second length 108 of hollow tube 8. In one embodiment, locking device 404 extends from a first elongated edge 406 of cradle 402 around hollow tube 8 to the opposing elongated edge (not illustrated) of cradle 402.

Locking device 404 is configured to be locked around hollow tube 8 and to be unlocked or loosen from around hollow tube 8 to permit the position of hollow tube 8 relative to stand 400 to be adjusted. As used herein, something that is "locked" is maintained in position and does not necessarily require a key combination, etc. to be unlocked (i.e. loosened). In one embodiment, locking device 404 includes a hook portion 410 and a latch portion 412. Hook portion 410 extends from the elongated edge of cradle 402 that is not illustrated and latch portion 412 extends from elongated edge 406. Hook portion 410 is separable from latch portion 412 to insert and/or adjust the position of hollow tube 8 relative to stand 400. In particular, when stand 400 is in the unlocked position, hollow tube 8 may be moved in a linear direction as generally indicated by arrow 416 and/or rotated as generally indicated by arrow 418. In one embodiment, upon positioning, latch portion 412 receives hook portion 410 and is tightened to maintain hollow tube 8 in the desired position.

More specifically, in one embodiment, latch portion 412 includes a clasp 420 and a buckle 422. In one embodiment, clasp 420 is an O-shaped or U-shaped member configured to receive a hook 424 of hook portion 410. Once hook 424 is received, buckle 422 is adjusted to pull clasp 420 toward first elongated edge 406, thereby, tightening locking device 404 around hollow tube 8. In one embodiment, locking device 404 functions similar to a buckle or latch found on a ski boot. Other locking mechanisms may also be used with cradle 402. In one embodiment, stand 400 is additionally adjustable at one or more lower legs 3 or 4 to adjust the trajectory of hollow tube 8 within cradle 402.

Figure 11A:
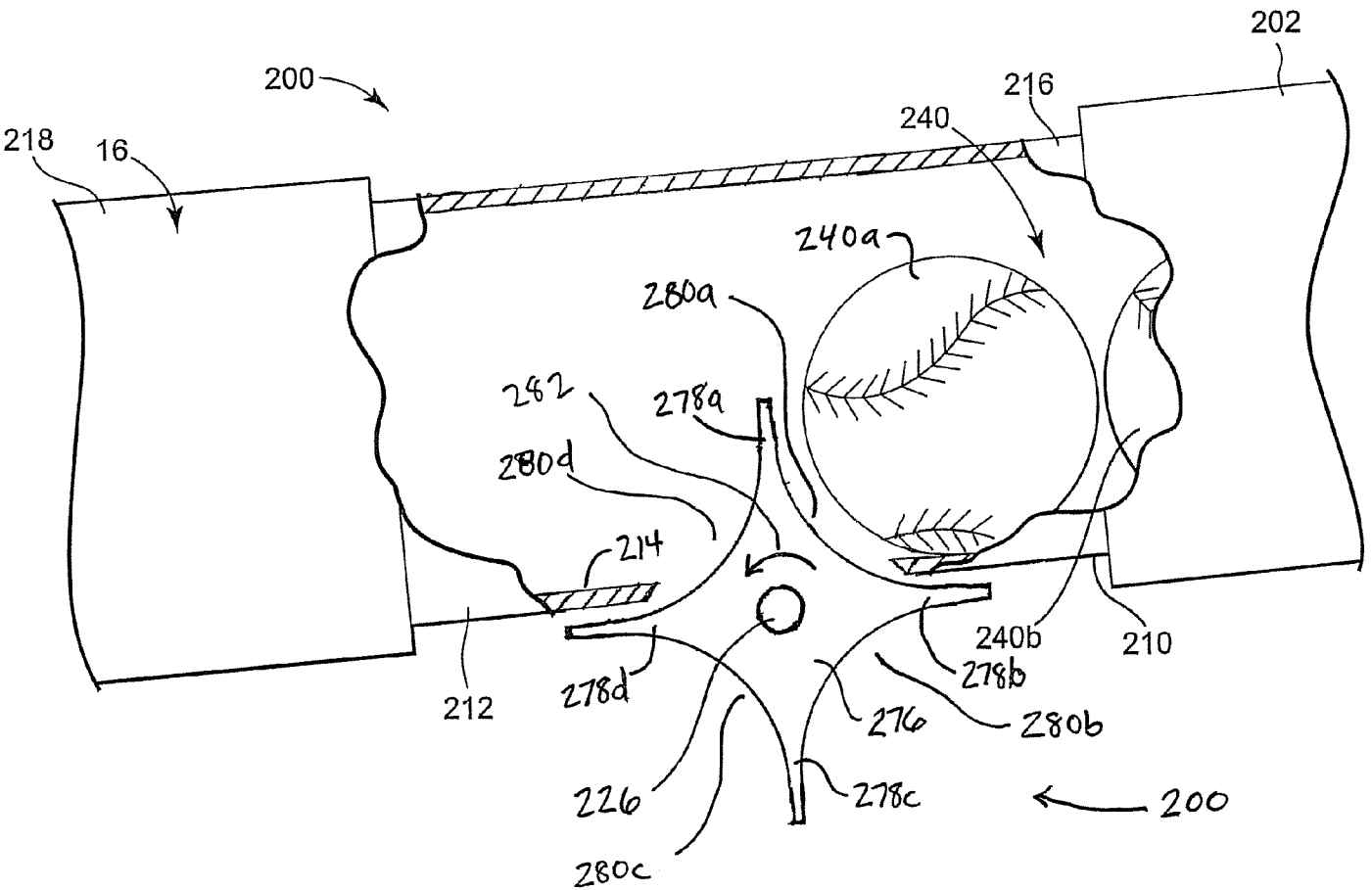
FIG. 11A illustrates one embodiment of an automatic feed mechanism in a first position.
Figure 11B:
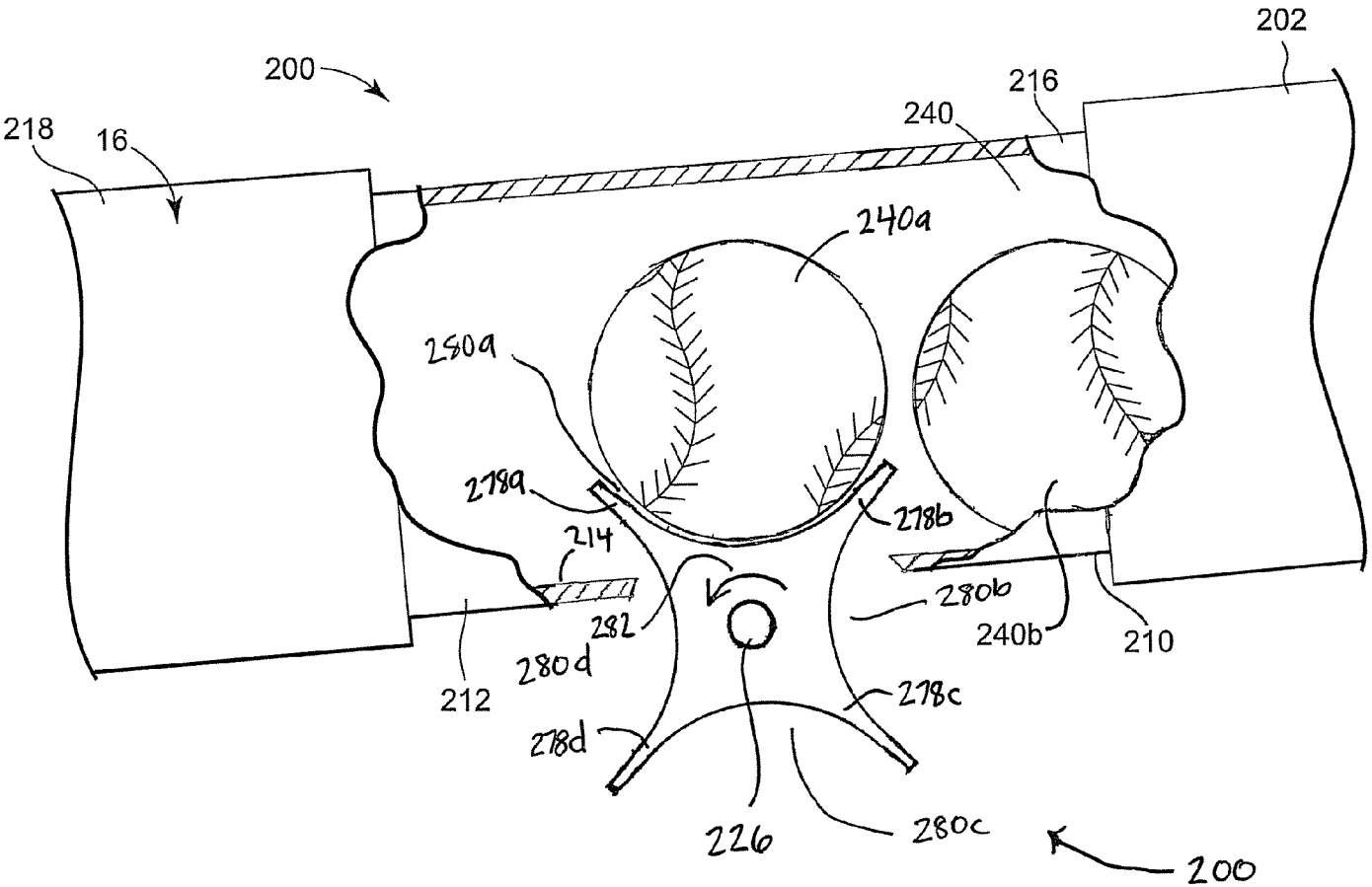
FIG. 11B illustrates the automatic feed mechanism of FIG. 11A in a second position.
Figure 11C:
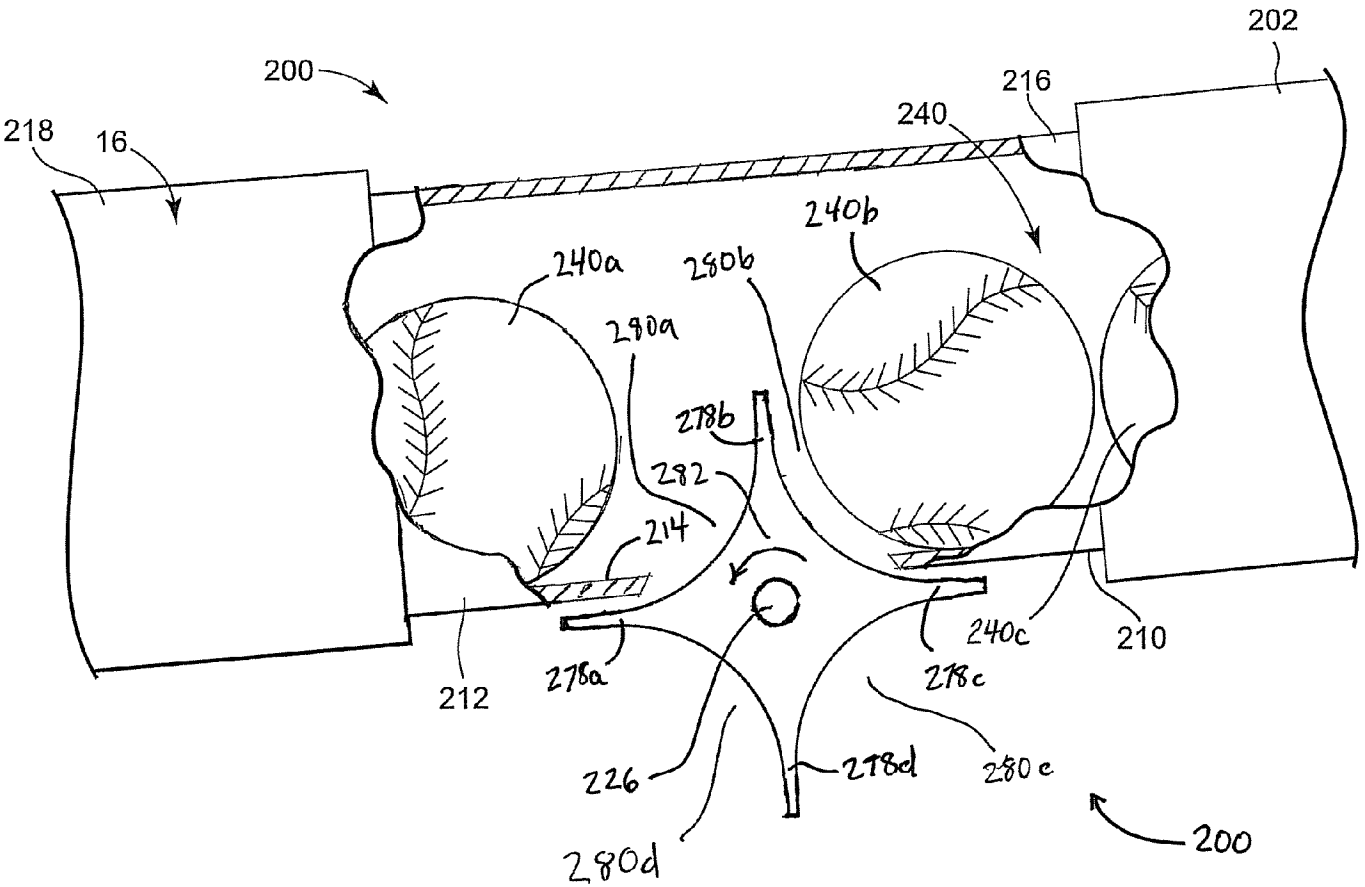
FIG. 11C illustrates the automatic feed mechanism of FIG. 11A in a third position.

FIGS. 11A-11C illustrate another embodiment of automatic feed mechanism 200 which comprises an integral part of plastic hollow tube 8. In one embodiment, automatic feed mechanism 200 may be positioned at any location along second length 108 of hollow tube 8. According to the embodiment of FIGS. 11A-11C, in lieu of employing deformable wheel 206, as illustrated by the embodiment of FIGS. 7A-7C, automatic feed mechanism 200 employs a wheel 276 having a plurality of a curved spokes 278 which together form a plurality of semicircular cradles 280 circumferentially about axis 226 which, as described below, are configured to engage and regulate the transport of balls 240 through hollow tube 8. In the embodiment of FIGS. 11A-11C, wheel 276 includes four curved spokes 278*a*-278*d* which together form four semicircular cradles 280*a*-280*d*, with wheel 276 being positioned such that spokes 278 extend at least partially into hollow tube 8.

During loading of balls 240 into hollow tube 8, gravity causes each ball 240 to roll through hollow tube 8 from first open end 18 or opening 32 into automatic feed mechanism 200 where they are stopped by spokes 278 of wheel 276. As illustrated by FIG. 11A, a first ball 240*a* is shown as being stopped by curved spoke 278*a*, with subsequent balls 240*b*, 240*c*, etc. positioned in hollow tube 8 behind first ball 240*a*.

With reference to FIG. 11B, upon activation of motor 208, wheel 276 rotates as indicated by rotational arrow 282 such that rotation of wheel 276 causes cradle 280*a* to engage and transport first ball 240*a* past wheel 276. In FIG. 11B, wheel 276 is illustrated as having rotated approximately 45-degrees from the position illustrated by FIG. 11A such that first ball 240*a* has been engaged by cradle 280*a* and is being moved past wheel 276 with the next ball 240*b* advancing by gravity through hollow tube 8 toward wheel 276.

With reference to FIG. 11C, as wheel 276 continues to rotate an additional 45-degrees, first ball 240*a* is released from cradle 280*a* and rolls through hollow tube 8 toward exit mechanism 16, and the next ball 240*b* is stopped from advancing by the next spoke 278*b*. After a set amount of time, automatic feed mechanism 200 rotates wheel 278 and additional 90-degrees and releases the ball 240*b*, with spoke 278*c* stopping the next ball 240*c*. This process is repeated in a similar fashion for each ball of the series of balls 240 so that each ball of the series is released in a spaced fashion from hollow tube 8.

Figure 12:
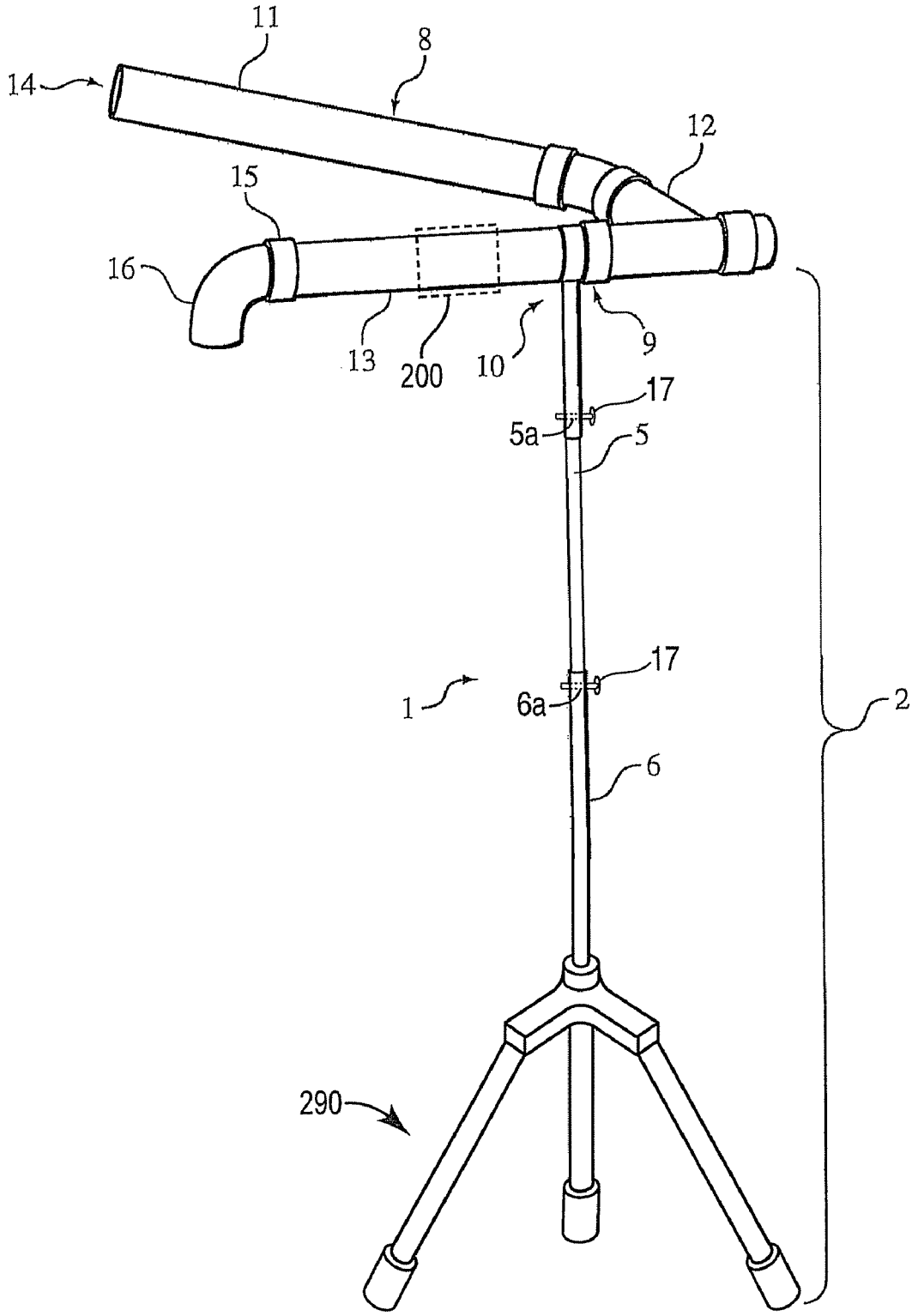
FIG. 12 illustrates a perspective view of one embodiment of a batting aid device.

FIG. 12 is a perspective view illustrating one embodiment of the batting aid described above employing a collapsible three-legged tripod 290 in lieu of the two-legged stand 2, as illustrated by FIG. 1A.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. An automatic feed mechanism for use with a batting aid device having a first end configured to receive a ball and a second end configured, by the force of gravity, to drop the ball from the batting aid device, the automatic feed mechanism comprising:

a substantially enclosed tubular member configured to receive a ball from the batting aid device and defining an internal support surface configured to support the ball;

a wheel coupled to and positioned at least partially within the tubular member and having a rotational axis orientated substantially perpendicular to a longitudinal extension of the tubular member; and a motor configured to rotate the wheel at least a portion of a full rotation; wherein the wheel initially forms a stop to prevent the ball from advancing through the tubular member via the force of gravity and dropping from the second end and, as the wheel rotates, the wheel engages and advances the ball past the wheel solely via rotation to enable the ball to advance through the tubular member by the force of gravity and drop from the second end of the batting aid device to a batter, wherein the rotational axis is at a fixed position during rotation of the wheel, wherein the tubular member includes an indentation which forms a planar outer surface to which the motor is slidably coupled, and wherein a position of the motor can be manually adjusted along the planar surface to adjust a position of the wheel within the tubular member based on a size of the ball.

2. The automatic feed mechanism of claim 1, wherein the batting aid device is configured to receive a series of balls via the first end, wherein the motor is configured to intermittently rotate the wheel at least a portion of a full rotation at a selected time interval, and wherein the wheel is configured to successively engage and advance one ball of the series toward the second end of the batting device with each intermittent rotation.

3. The automatic feed mechanism of claim 1, where the wheel comprises a deformable material, wherein as the wheel rotates, the wheel is configured to deform to receive the ball between the support surface and the deformed wheel and to advance the ball through the tubular member.

4. The automatic feed mechanism of claim 3, wherein the wheel comprises an elastomeric material.

5. The automatic feed mechanism of claim 3, wherein the tubular member includes an aperture formed through a wall of the tubular member opposite the support surface, the wheel being positioned to extend through the aperture.

6. The automatic feed mechanism of claim 1, wherein the motor is mounted to a side of the tubular member and an axle extends from the motor to the wheel.

7. The automatic feed mechanism of claim 1, wherein the tubular member includes a tubular cuff at the second end configured to receive a release mechanism, the release mechanism configured to alter an angle at which a ball is dropped from the second end to a batter.

8. The automatic feed mechanism of claim 2, wherein the selected interval is within a range from approximately 5 to 8 seconds such that one ball of the series of balls exits the second end in the range of approximately 5 to 8 seconds.

9. The automatic feed mechanism of claim 1, wherein the tubular member is selectively coupled to the batting aid device.

10. The automatic feed mechanism of claim 1, wherein the wheel has a thickness less than an inner diameter of the tubular member.

11. The automatic feed mechanism of claim 1, in combination with a release mechanism coupled with the automatic feed mechanism and configured to alter the angle at which the ball is dropped to a batter.

12. The automatic feed mechanism of claim 1, wherein the wheel comprises a plurality of curved spokes radially extending from and circumferentially spaced about the wheel.

13. A batting aid device comprising:

a vertically adjustable stand;

a V-shaped, hollow tube selectively coupled to the stand and comprising a first length of hollow tube extending between a first opening and a vertex, and a second length of hollow tube extending from the vertex to a second opening, the first opening being positioned vertically higher than the first opening and configured to receive a series Of balls which are gravity fed through the first and second lengths of hollow tubes so as to drop from the second opening to a batter; and an automatic feed mechanism integral to the second length of hollow tube and configured to control the release of balls from the second opening, the automatic feed mechanism comprising:

a wheel extending at least partially within the second length of hollow tube via an aperture therein and having a rotational axis orientated substantially perpendicular to a longitudinal extension of second length of hollow tube; and a motor configured to rotate the wheel at least a portion of a full rotation; wherein the wheel initially forms a stop and prevents a ball from advancing through the second length of hollow tube and, as the wheel rotates, the wheel engages and advances the ball past the wheel to enable the ball to advance through the second length of hollow tube and drop by gravity from the second opening to a batter, wherein the second length of hollow tube includes an indentation which forms a planar outer surface to which the motor is slidably coupled, and wherein a position of the motor can be manually adjusted along the planar surface to adjust a position of the wheel within the second length of hollow tube based on a size of the ball of the series of balls.

14. The automatic feed mechanism of claim 13, wherein the motor is configured to intermittently rotate the wheel at least a portion of a full rotation at a selected time interval, and wherein the wheel is configured to successively engage and advance one ball of the series toward the second opening with each intermittent rotation.

15. The automatic feed mechanism of claim 13, where the wheel comprises a deformable material, wherein as the wheel rotates, the wheel is configured to deform to receive the ball between the support surface and the deformed wheel and to advance the ball through the tubular member.

16. The automatic feed mechanism of claim 15, wherein the wheel comprises an elastomeric material.

17. The automatic feed mechanism of claim 14, wherein the selected interval is within a range from approximately 5 to 8 seconds such that one ball of the series of balls exits the second opening in the range of approximately 5 to 8 seconds.

18. The automatic feed mechanism of claim 14, wherein the automatic feed mechanism is configured to maintain a series of balls extending from the second opening to the first opening when the motor is off, and wherein when the motor is on, the wheel is configured to advance the series of balls for release towards a batter one ball at a time.

19. The automatic feed mechanism of claim 13, wherein the stand defines a cradle and a locking device configured to receive and hold the second length of hollow tube in a desired position.

20. The automatic feed mechanism of claim 19, wherein the locking device includes a hook and a buckle.

21. A batting aid device comprising:

a hollow tube configured to receive a series of balls via a first end and having a second end, the first end being vertically higher than the second end, and including an indentation which forms a planar outer surface;

a ball regulating mechanism comprising:

a wheel extending at least partially into the hollow tube and having a rotationally axis perpendicular to a longitudinal dimension of the hollow tube; and a motor slidably coupled to the planar outer surface of the hollow tube and having a shaft coupled to the wheel and configured to rotate the wheel about the rotational axis such that, solely via rotation, the wheel intermittently passes a ball past the wheel so that ball advances through and drops from the second end of the tube by gravity to a batter, wherein a position of the motor is adjustable to adjust how far the wheel extends into the hollow tube to enable balls of different diameters to be used with the batting aid device, wherein the rotational axis is at a fixed position during rotation of the wheel, and wherein a position of the motor can be manually adjusted along the planar outer surface to adjust a position of the wheel within the hollow tube based on a size of the ball.

* * * * *